US009296544B2

(12) United States Patent
Miyairi et al.

(10) Patent No.: US 9,296,544 B2
(45) Date of Patent: Mar. 29, 2016

(54) DOUBLE CONTAINER

(71) Applicants: Keisuke Miyairi, Tokyo (JP); Shintaro Kutsuzawa, Tokyo (JP); Keita Tanaka, Tokyo (JP)

(72) Inventors: Keisuke Miyairi, Tokyo (JP); Shintaro Kutsuzawa, Tokyo (JP); Keita Tanaka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/438,387

(22) PCT Filed: Oct. 15, 2013

(86) PCT No.: PCT/JP2013/006125
§ 371 (c)(1),
(2) Date: Apr. 24, 2015

(87) PCT Pub. No.: WO2014/068876
PCT Pub. Date: May 8, 2014

(65) Prior Publication Data

US 2015/0298890 A1 Oct. 22, 2015

(30) Foreign Application Priority Data

Oct. 31, 2012 (JP) ..... 2012-241340
Oct. 31, 2012 (JP) ..... 2012-241379
Oct. 31, 2012 (JP) ..... 2012-241380

(51) Int. Cl.
*B65D 83/00* (2006.01)
*B65D 1/02* (2006.01)

(52) U.S. Cl.
CPC ..... *B65D 83/0061* (2013.01); *B65D 1/0215* (2013.01); *B65D 83/0055* (2013.01)

(58) Field of Classification Search
CPC .. B65D 1/0215; B65D 23/02; B65D 23/0821; B65D 2501/0027; B65D 2501/0063; B65D 83/0061; B65D 83/055
USPC ..... 215/12.1, 12.2, 383, 380
See application file for complete search history.

(56) References Cited

U.S. PATENT DOCUMENTS 4,868,026 A * 9/1989 Shimizu ..... B29C 45/1643 215/12.2
5,301,838 A * 4/1994 Schmidt ..... B67D 1/0462 222/105

(Continued)

FOREIGN PATENT DOCUMENTS

CN 101547836 A 9/2009
JP H06-505463 A 6/1994

(Continued)

OTHER PUBLICATIONS

Apr. 8, 2015 Office Action issued in Taiwanese Application No. 102138831.

(Continued)

*Primary Examiner* — Robert J Hicks
*Assistant Examiner* — Niki Eloshway
(74) *Attorney, Agent, or Firm* — Oliff PLC

(57) ABSTRACT

Double container (1) includes outer layer body (2) including tubular dispensing spout (2*a*) and trunk portion (2*b*). Dispensing spout (2*a*) is provided, in its side portion, with air inlet hole (4) extending through dispensing spout (2*a*) from inside to outside. Double container (1) also includes inner layer body (3) including opening (3*a*) contiguous with opening edge of dispensing spout (2*a*), and content container portion (3*b*) contiguous with opening (3*a*). Inner layer body (3) is accommodated in outer layer body (2). Trunk portion (2*b*) is provided with outer-layer-side projecting portions (5, 11, 17, 33, 34), and inner layer body (3) is provided with inner-layer-side projecting portions (6, 12, 19, 33', 34') having shapes corresponding to inner surfaces of outer-layer-side projecting portions (5, 11, 17, 33, 34). Space is provided between outer-layer-side projecting portions (5, 11, 17, 33, 34) and inner-layer-side projecting portions (6, 12, 19, 33', 34').

12 Claims, 19 Drawing Sheets

(56) References Cited

U.S. PATENT DOCUMENTS

| | | | | |
|---|---|---|---|---|
| 6,205,847 | B1 * | 3/2001 | Nomoto | B65D 1/0215 73/49.2 |
| 6,244,454 | B1 * | 6/2001 | Yoshioka | B29C 49/0005 215/12.2 |
| 6,266,943 | B1 * | 7/2001 | Nomoto | B05B 11/0043 156/244.14 |
| 6,276,558 | B1 * | 8/2001 | Kneer | B05B 11/0043 215/12.1 |
| 7,055,707 | B2 * | 6/2006 | Yoneyama | B29C 49/0073 215/12.1 |
| 8,925,748 | B2 * | 1/2015 | Van Hove | B29C 49/06 215/12.1 |
| 8,931,651 | B2 * | 1/2015 | Van Hove | B29B 11/14 215/12.1 |
| 2001/0027154 | A1 | 10/2001 | Nomoto et al. | |

FOREIGN PATENT DOCUMENTS

| | | | |
|---|---|---|---|
| JP | H06-345069 | A | 12/1994 |
| JP | H09-2529 | A | 1/1997 |
| JP | 2001-106263 | A | 4/2001 |
| JP | 2003-192031 | A | 7/2003 |
| JP | 2006-036250 | A | 2/2006 |
| JP | 2007-091291 | A | 4/2007 |
| JP | 2010-030659 | A | 2/2010 |

OTHER PUBLICATIONS

May 5, 2015 English-language translation of International Preliminary Report on Patentability issued in International Application No. PCT/JP2013/006125.

Jan. 21, 2014 International Search Report issued in PCT/JP2013/006125.

Nov. 13, 2015 Office Action issued in Chinese Patent Application No. 201380056280.1.

Sep. 16, 2015 Office Action issued in Australian Patent Application No. 2013340152.

* cited by examiner

Appearance of container

Before peeled

After peeled

During molding

When container is removed

Appearance of container
(with low level of raise in bottom portion)

Before peeled

After peeled

During molding

When container is removed

DOUBLE CONTAINER

TECHNICAL FIELD

The present invention relates to a double container having a double-layered structure with an inner layer body and an outer layer body. The inner layer is configured to contain a content and accommodated in the outer layer body. At the time of dispensing the content, ambient air is introduced between the outer layer body and the inner layer body from an air inlet hole to shrink only the inner layer body.

BACKGROUND

As such containers that contain cosmetics such as face lotion, shampoo, rinse, liquid soap, food seasoning, or the like, there is known a double container that includes an inner layer body having a container portion for containing the content and an outer layer body accommodating the inner layer body in a manner such that the inner layer body is peelable from the outer layer body. The content is dispensed by pressing a trunk portion of the outer layer body. After the pressing is released, ambient air is introduced between the inner layer body and the outer layer body from an air inlet hole provided in a dispensing spout of the outer layer body, and as a result, the trunk portion is restored while the volume of the inner layer body remains reduced (Refer to Patent Literatures 1 and 2, for example). Since a container of this type is capable of dispensing the content without the need for replacing the content with ambient air, contact between the content and ambient air is limited, and the content is prevented from undergoing deterioration and a change in quality.

CITATION LIST

Patent Literature

PTL 1: JP2001106263A
PTL 2: JP2006036250A

SUMMARY

One known example of such a double container is a peelable laminated container, which is also called delamination container. In this example, the double container is configured to have a laminated structure including an outer layer body and an inner layer body that are closely joined to each other, for example, by preparing a laminated parison by co-extruding relatively incompatible synthetic resins each for the outer layer and the inner layer and by blow molding the prepared laminated parison with a metal mold. Accordingly, the blow molding is followed, for example, by shrinking the inner layer body by pumping of air from the air inlet hole or by suction of air from the dispensing spout with negative pressure, in order to peel the entire inner layer body from the outer layer body. Subsequently, air is fed to the inside of the inner layer body to join the entire inner layer body closely to the outer layer body again. Thus, at the time of dispensing the content, the peeling of the inner layer body from the outer layer body is facilitated.

However, in the conventional double container, even when the blow molding is followed by temporarily peeling the entire inner layer body from the outer layer body as described above, the entire outer surface of the inner layer body is joined closely to the entire inner surface of the outer layer body again. Consequently, at the time of dispensing the content, air is prevented from entering between the outer layer body and the inner layer body from the air inlet hole, possibly resulting in peeling failure of the inner layer body and deformation of the outer layer body.

Patent Literature 2 discloses a container including an outer layer body and an inner layer body, wherein a portion of the outer layer body is cut out to form an air inlet hole, and a portion of the inner layer body in correspondence with the air inlet hole is reversely bulged inward to form an ambient air introduction path on an inner periphery of the air inlet hole. Nevertheless, even the technology disclosed in Patent Literature 2 does not necessarily ensure smooth peeling of the inner layer body from the outer layer body depending on the shape of the container.

The present invention has been conceived to solve the aforementioned conventional problems, and one objective of the present invention is to provide a double container that is capable of facilitating the peeling of the inner layer body from the outer layer body and preventing the peeling failure of the inner layer body and the deformation of the outer layer body at the time of dispensing the content.

Another objective of the present invention is to provide a double container that is capable of facilitating the introduction of ambient air in use and is also capable of facilitating the peeling of the inner layer body from the outer layer body and that affords a high degree of freedom in the selection of the shape of the container.

One aspect of the present invention resides in a double container, including: an outer layer body including a tubular dispensing spout and a trunk portion that is contiguous with the dispensing spout, the dispensing spout being provided in a side portion thereof with an air inlet hole extending through the dispensing spout from an inside to an outside thereof; and an inner layer body including an opening, which is contiguous with an opening edge of the dispensing spout, and a content container portion, which is contiguous with the opening, the inner layer body being accommodated in the outer layer body. The trunk portion included in the outer layer body is provided with an outer-layer-side projecting portion. The inner layer body is provided with an inner-layer-side projecting portion having a shape that corresponds to an inner surface of the outer-layer-side projecting portion. Space is provided between the outer-layer-side projecting portion and the inner-layer-side projecting portion.

In the double container according to the first aspect, preferably, the inner surface of the outer-layer-side projecting portion that faces to the side of the inner layer body has an undercut shape in a longitudinal section thereof in a direction along an axis of the dispensing spout, and the inner-layer-side projecting portion, in a longitudinal section thereof, has the shape that corresponds to the inner surface of the outer-layer-side projecting portion.

In the double container according to the second aspect, preferably, the outer-layer-side projecting portion projects toward the inner layer body.

In the double container according to the third aspect, preferably, the trunk portion includes a bottom portion opposing to the dispensing spout, the bottom portion having a concave shape in which a center side thereof is depressed toward the dispensing spout relative to an outer circumferential edge thereof, and an outer surface of the outer-layer-side projecting portion that faces to the opposite side to the inner layer body has a concave shape including an inclined surface, which is inclined closer to the dispensing spout as the inclined surface extends further inward of the trunk portion, a flat surface, which is located closer to the dispensing spout relative to the inclined surface and which is perpendicular to the axis of the dispensing spout, and a cut-out surface, which connects the inclined surface and the flat surface and which is depressed toward the dispensing spout relative to the flat surface.

In the double container according to the third aspect, preferably, an outer surface of the outer-layer-side projecting portion that faces to the opposite side to the inner layer body has a concave shape including a flat surface, which is perpendicular to the axis of the dispensing spout, and a curved surface, which is located closer to the dispensing spout relative to the flat surface and which connects to the flat surface.

In the double container according to the second aspect, preferably, at least a portion of the outer-layer-side projecting portion is arranged in a range from 60 degrees or more to 90 degrees or less from an axis of the air inlet hole in a direction toward a bottom portion included in the trunk portion, in a plan view seen from an axis direction of the air inlet hole.

In the double container according to the first aspect, preferably, the outer-layer-side projecting portion includes an outer layer rib extending in a direction from the dispensing spout to a bottom portion, and an inner surface of the outer layer rib that faces to the side of the inner layer body has an undercut shape in a transverse section thereof, and the inner-layer-side projecting portion includes an inner layer rib that, in a transverse section thereof, has a shape corresponding to the inner surface of the outer layer rib.

In the double container according to the seventh aspect, preferably, the outer layer rib, in a transverse section thereof, has a U-shape including a pair of side wall portions and a ceiling wall portion that connects the pair of side wall portions, and an outer surface of the outer layer rib that faces to the opposite side to the inner layer body, in a transverse section thereof, has a shape including a pair of outer surfaces of the side wall portions having linear portions which is in parallel with each other, and a outer surface of the ceiling wall portion having a connecting side portion connects the pair of linear portions.

In the double container according to the eighth aspect, preferably, the trunk portion of the outer layer body is further provided with a sub-outer layer rib that is adjacent to the outer layer rib, and an outer surface of the sub-outer layer rib that faces to the opposite side to the inner layer body, in a transverse section thereof, has a shape including an inclined side, which connects to the linear portion of the outer layer rib and which is inclined relative to the linear portion.

In the double container according to the ninth aspect, preferably, in the transverse section, the linear portion of the outer layer rib extends substantially in parallel with a line that passes a widthwise middle point of the sub-outer layer rib and that also passes an axis of the dispensing spout.

In the double container according to the seventh aspect, preferably, at least a portion of the outer layer rib is arranged in a range from 60 degrees or more to 90 degrees or less from an axis of the air inlet hole in a direction toward the bottom portion, in a plan view seen from an axis direction of the air inlet hole.

In the double container according to the first aspect, preferably, the outer-layer-side projecting portion includes an outer-layer-side longitudinal rib extending in a direction from the dispensing spout to a bottom portion, the inner-layer-side projecting portion includes an inner-layer-side longitudinal rib extending in the direction from the dispensing spout to the bottom portion, and the outer-layer-side longitudinal rib and the inner-layer-side longitudinal rib are arranged in an area extending in the range of a central angle of 90° downward from the air inlet hole.

In the double container according to the twelfth aspect, preferably, in each of two areas, one each on left and right sides, determined by excluding an area extending in the range of a central angle of less than 60° downward from the air inlet hole, from the area extending in the range of a central angle of 90° downward from the air inlet hole, at least a portion of the outer-layer-side longitudinal rib and at least a portion of the inner-layer-side longitudinal rib are arranged.

In the double container according to the twelfth aspect, preferably, the outer-layer-side longitudinal rib is provided in plurality, and the plurality of outer-layer-side longitudinal rib includes at least four outer-layer-side longitudinal ribs, and two areas, one each on left and right sides, determined by excluding an area extending in the range of a central angle of less than 60° downward from the air inlet hole, from the area extending in the range of a central angle of 90° downward from the air inlet hole, communicate to areas defined between two outer-layer-side longitudinal ribs in pair.

According to the present invention, since the trunk portion included in the outer layer body is provided with an outer-layer-side projecting portion, the inner layer body is provided with an inner-layer-side projecting portion having a shape that corresponds to an inner surface of the outer-layer-side projecting portion, and space is provided between the outer-layer-side projecting portion and the inner-layer-side projecting portion, after the inner layer body is peeled from the outer layer body, the inner layer is prevented from easily joining closely to the outer layer body. Accordingly, space is maintained around the projecting portions between the outer layer body and the inner layer body. The space serves as a flow path through which ambient air introduced from the air inlet hole flows between the outer layer body and the inner layer body at the time of dispensing the content. This facilitates the peeling of the inner layer body from the outer layer body and prevents the peeling failure of the inner layer body and the deformation of the outer layer body in the double container.

In the present invention, when the inner surface of the outer-layer-side projecting portion that faces to the side of the inner layer body has an undercut shape in a longitudinal section thereof in a direction along an axis of the dispensing spout, and the inner-layer-side projecting portion, in a longitudinal section thereof, has the shape that corresponds to the inner surface of the outer-layer-side projecting portion, after the inner layer body is peeled from the outer layer body, the inner-layer-side projecting portion provided in the inner layer body has difficulty fitting into the outer-layer-side projecting portion provided in the outer layer body, and the space is maintained around the projecting portions between the outer layer body and the inner layer body.

In the above configuration, when the outer-layer-side projecting portion projects toward the inner layer body, the aforementioned advantageous effect is achieved without compromising the aesthetics of appearance and the operability of the double container.

In the above configuration, when the trunk portion includes a bottom portion opposing to the dispensing spout, the bottom portion having a concave shape in which a center side thereof is depressed toward the dispensing spout relative to an outer circumferential edge thereof, and an outer surface of the outer-layer-side projecting portion that faces to the opposite side to the inner layer body has a concave shape including an inclined surface, which is inclined closer to the dispensing spout as the inclined surface extends further inward of the trunk portion, a flat surface, which is located closer to the dispensing spout relative to the inclined surface and which is perpendicular to the axis of the dispensing spout, and a cut-out surface, which connects the inclined surface and the flat surface and which is depressed toward the dispensing spout relative to the flat surface, the undercut shape is easily imparted to the inner surface of the outer-layer-side projecting portion during the blow molding with the metal mold. Furthermore, when the double container is removed from the metal mold after the blow molding, the metal mold is easily released from the outer-layer-side projecting portion by displacing the double container upward in accordance with the shape of the bottom portion.

In the above configuration, when an outer surface of the outer-layer-side projecting portion that faces to the opposite side to the inner layer body has a concave shape including a flat surface, which is perpendicular to the axis of the dispensing spout, and a curved surface, which is located closer to the dispensing spout relative to the flat surface and which connects to the flat surface, the undercut shape is easily imparted to the inner surface of the outer-layer-side projecting portion by the blow molding.

In the above configuration, when at least a portion of the outer-layer-side projecting portion is arranged in a range from 60 degrees or more to 90 degrees or less from an axis of the air inlet hole in a direction toward a bottom portion included in the trunk portion, in a plan view seen from an axis direction of the air inlet hole, space of the creases arising around the air inlet hole when the inner layer body is joined to the outer layer body again after being peeled from the outer layer body is allowed to communicate with the space maintained between the outer-layer-side projecting portion and the inner-layer-side projecting portion. Accordingly, the presence of the air flow path between the air inlet hole and the trunk portion is further ensured.

In the present invention, when the outer-layer-side projecting portion includes an outer layer rib extending in a direction from the dispensing spout to a bottom portion, an inner surface of the outer layer rib that faces to the side of the inner layer body has an undercut shape in a transverse section thereof, and the inner-layer-side projecting portion includes an inner layer rib that, in a transverse section thereof, has a shape corresponding to the inner surface of the outer layer rib, after the inner layer body is peeled from the outer layer body, the inner layer rib provided in the inner layer body has difficulty fitting into the outer layer rib provided in the outer layer body, and the space is maintained around the ribs between the outer layer body and the inner layer body.

In the above configuration, when the outer layer rib, in a transverse section thereof, has a U-shape including a pair of side wall portions and a ceiling wall portion that connects the pair of side wall portions, and an outer surface of the outer layer rib that faces to the opposite side to the inner layer body, in a transverse section thereof, has a shape including a pair of outer surfaces of the side wall portions having linear portions which is in parallel with each other, and a outer surface of the ceiling wall portion having a connecting side portion which connects the pair of linear portions, at the time of blow molding the laminated parison with the metal mold to configure the double container, the laminated parison is stretched in the metal mold so that the thickness of corner portions connecting both the side wall portions and the ceiling wall portion of the outer layer rib may be reduced. Thus, the outer layer rib whose inner surface has the undercut shape in the transverse section, together with the inner layer rib having the shape corresponding to the inner surface of the outer layer rib in the transverse section, is easily formed.

In the above configuration, when the trunk portion of the outer layer body is further provided with a sub-outer layer rib that is adjacent to the outer layer rib, and an outer surface of the sub-outer layer rib that faces to the opposite side to the inner layer body, in a transverse section thereof, has a shape including an inclined side, which connects to the linear portion of the outer layer rib and which is inclined relative to the linear portion, at the time of blow molding the laminated parison with the metal mold, the laminated parison tends to flow toward the sub-outer layer rib along the inclined sides. Accordingly, the laminated parison is stretched further toward the corner portions connecting both the side wall portions and the ceiling wall portion of the outer layer rib, allowing deeper undercut shapes to be imparted to the transverse sections of the outer layer rib and the inner layer rib.

In the above configuration, when, in the transverse section, the linear portion of the outer layer rib extends substantially in parallel with a line that passes a widthwise middle point of the sub-outer layer rib and that also passes an axis of the dispensing spout, at the time of blow molding the laminated parison with the metal mold, the laminated parison is stretched further toward the corner portions connecting both the side wall portions and the ceiling wall portion of the outer layer rib in the metal mold, allowing deeper undercut shapes to be imparted to the transverse sections of the outer layer rib and the inner layer rib.

In the above configuration, when at least a portion of the outer layer rib is arranged in a range from 60 degrees or more to 90 degrees or less from an axis of the air inlet hole in a direction toward the bottom portion, in a plan view seen from an axis direction of the air inlet hole, space of the creases arising around the air inlet hole when the inner layer body is joined to the outer layer body again after being peeled from the outer layer body is allowed to communicate with the space maintained between the outer layer rib and the inner layer rib. Accordingly, the presence of the air flow path between the air inlet hole and the trunk portion is further ensured.

In the present invention, when the outer-layer-side projecting portion includes an outer-layer-side longitudinal rib extending in a direction from the dispensing spout to a bottom portion, the inner-layer-side projecting portion includes an inner-layer-side longitudinal rib extending in the direction from the dispensing spout to the bottom portion, and the outer-layer-side longitudinal rib and the inner-layer-side longitudinal rib are arranged in an area extending in the range of a central angle of 90° downward from the air inlet hole, by undergoing an initial peeling process, the double container releases the inner-layer-side longitudinal rib from the fitted state with the outer-layer-side longitudinal rib, thereby ensuring that an ambient air introduction path may be maintained on the periphery of the outer-layer-side longitudinal rib and the inner-layer-side longitudinal rib in the trunk portion. Furthermore, the ambient air introduction path maintained in the trunk portion of the container communicates with the air inlet hole provided in the mouth portion of the container. As a result, the introduction of ambient air to the trunk portion of the container in use is facilitated, and the peeling of the inner layer body from the outer layer body is also facilitated, and moreover, the double container affords a high degree of freedom in the selection of the shape of the container.

DETAILED DESCRIPTION

Exemplary embodiments of the present invention will be described in detail with respect to the drawings.

Figure 1:
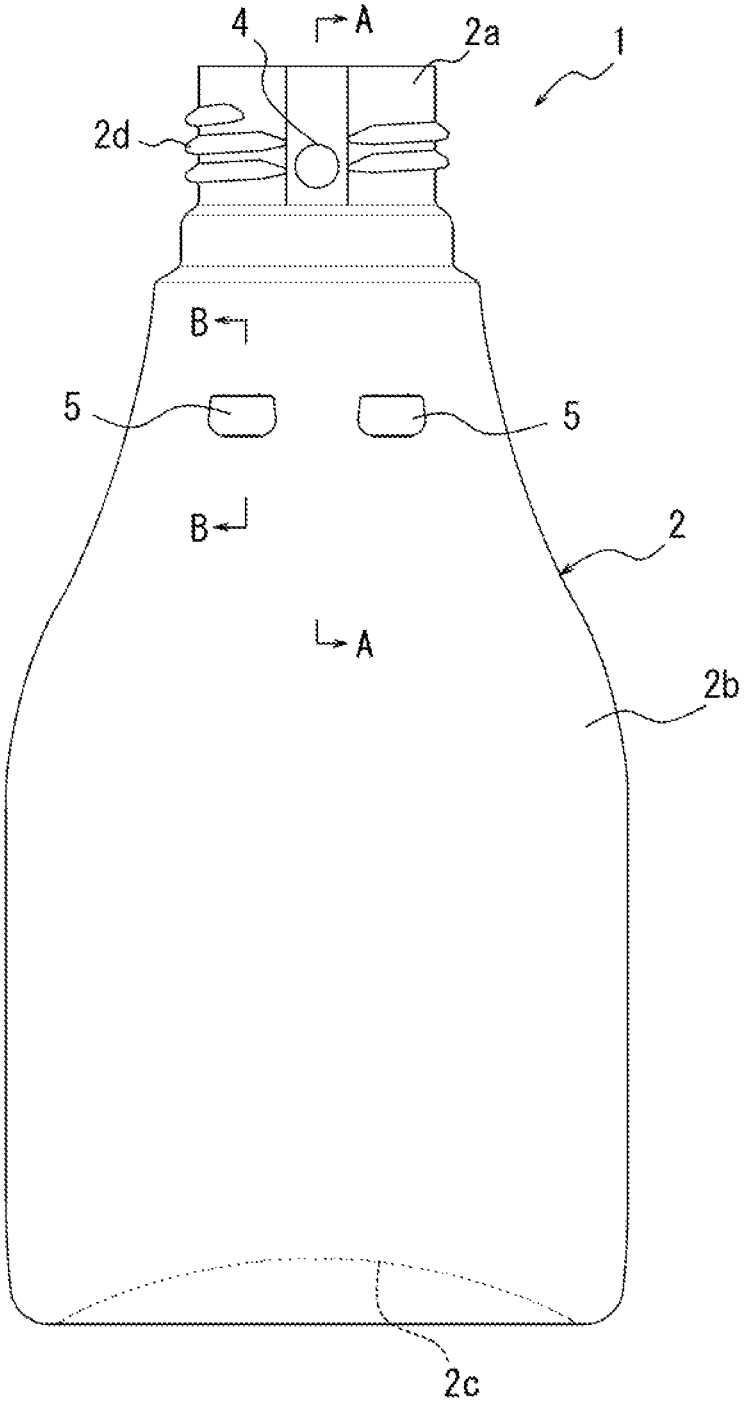
FIG. 1 is a front view of a peelable laminated container according to one embodiment of a double container of the present invention.
Figure 2:
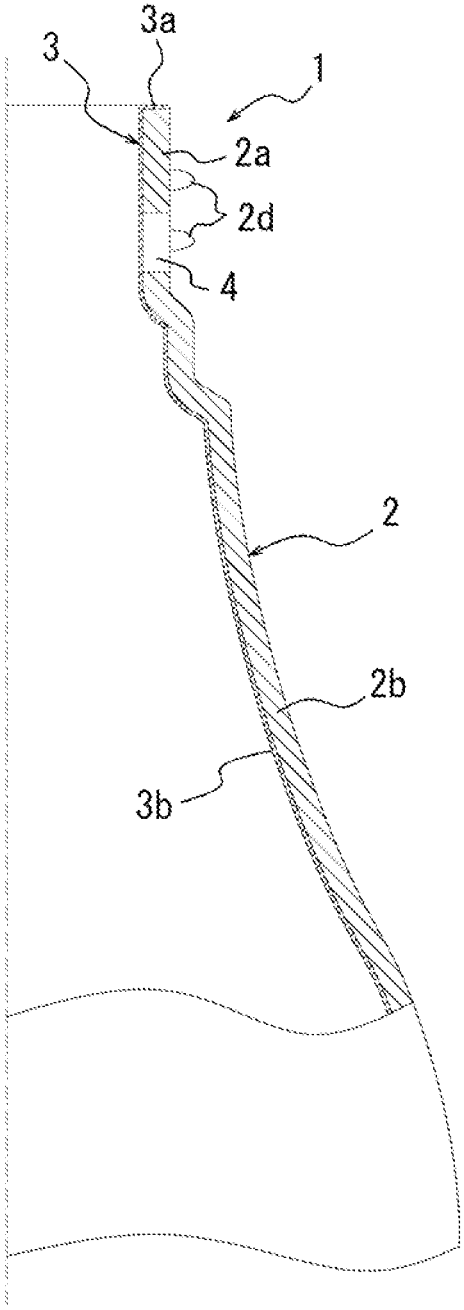
FIG. 2 is a sectional view taken along a line A-A in FIG. 1.

As illustrated in FIGS. 1 to 3, a peelable laminated container 1 according to one embodiment of a double container of the present invention includes an outer layer body 2 constituting an outer shell and an inner layer body 3 accommodated in the outer layer body 2. The peelable laminated container 1, which is also called delamination container, is configured to have a laminated structure with the outer layer body 2 and the inner layer body 3 that is closely joined to the inner surface of the outer layer body 2 in a manner such that the inner layer body 3 is peelable from the outer layer body 2, for example, by preparing a laminated parison by co-extruding relatively incompatible synthetic resins each for the outer layer and the inner layer and by blow molding the prepared laminated parison with a metal mold.

The outer layer body 2 has a bottle shape including a tubular dispensing spout 2*a* that has a circular section and a trunk portion 2*b* that is integrally contiguous with the dispensing spout 2*a* and that has a circular section. The trunk portion 2*b* may be flexible enough to be dented when being squeezed and to be restored to the original shape from the dented state. The trunk portion 2*b* also includes a bottom portion 2*c* opposing to the dispensing spout 2*a*. The bottom portion 2*c* has a concave shape in which the center side is depressed toward the dispensing spout 2*a* relative to the outer circumferential edge.

The inner layer body 3 is formed in a bag shape with a smaller thickness than the outer layer body 2, and the outer surface of the inner layer body 3 is joined closely to the inner surface of the outer layer body 2 in a peelable manner. The inner layer body 3 includes an opening 3*a* that is contiguous with the opening edge of the dispensing spout 2*a* included in the outer layer body 2. The inner layer body 3 also includes, inside thereof, a container portion 3*b* that is contiguous with the opening 3*a*. The container portion 3*b* may contain a liquid content, including cosmetics such as face lotion, shampoo, rinse, liquid soap, or food seasoning.

The dispensing spout 2*a* of the outer layer body 2 is provided in a side portion (an outer circumferential portion) thereof with an air inlet hole 4 extending through the dispensing spout 2*a* along a radial direction from an inside to an outside thereof. The air inlet hole 4 communicates between the outer layer body 2 and the inner layer body 3, and therefore, when the inner layer body 3 is peeled from the outer layer body 2, ambient air is introduced between the outer layer body 2 and the inner layer body 3.

The dispensing spout 2*a* of the outer layer body 2 is configured to allow members, such as a dispensing cap provided with a dispensing valve, various types of a nozzle, and a dispensing pump, to be mounted thereon. The content is dispensed through these members. These members may be screwed to a screw portion 2*d*, which is provided in the dispensing spout 2*a*, to be fixed to the dispensing spout 2*a*. However, these members may also be fixed by any other means such as an undercut.

The peelable laminated container 1 as described above, when a dispensing cap provided with a dispensing valve is mounted on the dispensing spout 2*a*, may dispense the content from the dispensing spout 2*a* in response to squeezing of the trunk portion 2*b* of the outer layer body 2. After the dispensing of the content, the outer layer body 2 is restored to the original shape. At this time, since ambient air flows between the outer layer body 2 and the inner layer body 3, the outer layer body 2 is restored to the original shape while the volume of the container portion 3*b* of the inner layer body 3 remains reduced. Thus, the dispensing of the content does not cause ambient air to enter from the dispensing spout 2*a* to the inside of the container portion 3*b* of the inner layer body 3, and the content contained in the container portion 3*b* is prevented from contact with air, and therefore, from deterioration. Meanwhile, the content contained in the container portion 3*b* may also be dispensed from the dispensing spout 2*a* by its own weight, by tilting the outer layer body 2. Furthermore, when a pump is mounted on the dispensing spout 2*a*, the outer layer body 2 may be inflexible.

As illustrated in FIGS. 1 and 2, the trunk portion 2*b* of the outer layer body 2 is provided with a circumferentially arranged pair of outer-layer-side projecting portions 5 for facilitating the peeling of the inner layer body 3 from the outer layer body 2 at the time of dispensing the content. The outer-layer-side projecting portions 5 may be integrally formed on the trunk portion 2*b* by blow molding with the metal mold. The pair of outer-layer-side projecting portions 5 has substantially the same structure, and a description is given below only of one of the outer-layer-side projecting portions 5.

As illustrated in FIG. 3, the outer-layer-side projecting portion 5 is provided in the outer layer body 2 to project toward the inner layer body 3, that is to say, toward an inside of the peelable laminated container 1 relative to the outer circumferential surface of the outer layer body 2. The appearance of the outer-layer-side projecting portion 5 is in a concave shape that is depressed inward relative to the outer circumferential surface of the outer layer body 2.

The outer-layer-side projecting portion 5 includes an upper wall 5*a*, a lower wall 5*b*, a connecting wall 5*c*, and a pair of side walls 5*d*. The upper wall 5*a* extends perpendicularly to an axis of the dispensing spout 2*a*. The lower wall 5*b* is disposed below the upper wall 5*a*, that is to say, closer to the bottom portion 2*c*. The lower wall 5*b* is inclined closer to the dispensing spout 2*a* as the lower wall 5*b* extends further inward of the trunk portion 2*b*, with respect to a direction that is perpendicular to the axis of the dispensing spout 2*a*. The connecting wall 5*c* connects the upper wall 5*a* and the lower wall 5*b*. The connecting wall 5*c* is formed in a curved shape in which a portion of the connecting wall 5*c* bulges out toward the dispensing spout 2*a* relative to the upper wall 5*a*. The side walls 5*d* connect to circumferential end portions of the upper wall 5*a*, the lower wall 5*b*, and the connecting wall 5*c* to define circumferential end portions of the concave shape of the outer-layer-side projecting portion 5. Although FIG. 3 illustrates one of the pair of the side walls 5*d* only, the similar side wall 5*d* is also provided on the other end portion of the outer-layer-side projecting portion 5.

The upper wall 5*a* has an outer surface defined as a flat surface 5*e* that is perpendicular to the axis of the dispensing spout 2*a*. The lower wall 5*b* also has an outer surface defined as an inclined surface 5*f* that is inclined closer to the dispensing spout 2*a* as the inclined surface 5*f* extends further inward of the trunk portion 2*b*. The connecting wall 5*c* also has an outer surface defined as a cut-out surface 5*g* that connects the flat surface 5*e* and the inclined surface 5*f* and that is partly depressed toward the dispensing spout 2*a* relative to the flat surface 5*e*. In the present embodiment, the cut-out surface 5*g* is formed around a junction between the upper wall 5*a* and the connecting wall 5*c*. In this way, the outer surface of the outer-layer-side projecting portion 5 that faces to the opposite side to the inner layer body 3 includes the flat surface 5*e*, the inclined surface 5*f*, and the cut-out surface 5*g*.

On the other hand, the inner surface of the outer-layer-side projecting portion 5 that faces to the side of the inner layer body 3 has an undercut shape in the longitudinal section in a direction along the axis of the dispensing spout 2*a*. That is to say, the inner surface of the connecting wall 5*c* of the outer-layer-side projecting portion 5 that faces to the side of the inner layer body 3 partly projects toward the dispensing spout 2*a* relative to the upper wall 5*a*. Thus, the outer-layer-side projecting portion 5 has the undercut shape with respect to a direction that is perpendicular to the inner surface of the outer layer body 2, that is to say, a direction in which the inner layer body 3 is peeled from the outer layer body 2.

Figure 3A:
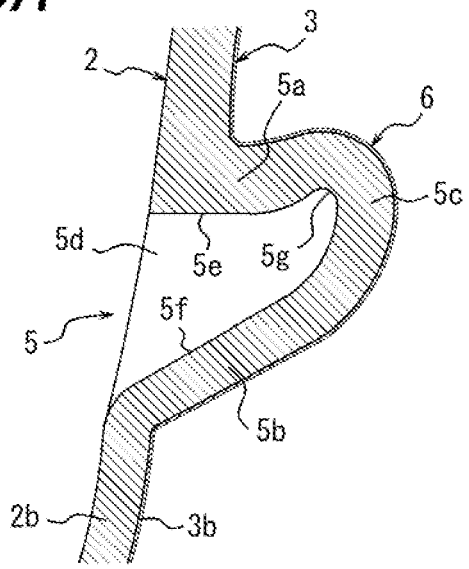
FIG. 3A is a sectional view taken along a line B-B in FIG. 1, illustrating a state of an inner layer body before being peeled.

In correspondence with the pair of outer-layer-side projecting portions 5, a pair of inner-layer-side projecting portions 6 are provided in the inner layer body 3. Although FIG. 3 merely illustrates one of the pair of inner-layer-side projecting portions 5*d* in correspondence with the one of the pair of outer-layer-side projecting portions, the other one of the pair of inner-layer-side projecting portions 6 is also provided in the inner layer body 3 in correspondence with the other one of the pair of outer-layer-side projecting portions 5. The inner-layer-side projecting portion 6 projects from the outer circumferential surface of the inner layer body 3 toward an inside of the inner layer body 3. The inner-layer-side projecting portion 6, in the longitudinal section, has a shape that corresponds to the inner surface of the outer-layer-side projecting portion 5. The outer surface of the inner-layer-side projecting portion 6 has a shape that is substantially the same as the shape of the inner surface of the outer-layer-side projecting portion 5. As illustrated in FIG. 3A, after blow molding, the outer surface of the inner-layer-side projecting portion 6 is closely joined to the inner surface of the outer-layer-side projecting portion 5.

Figure 3B:
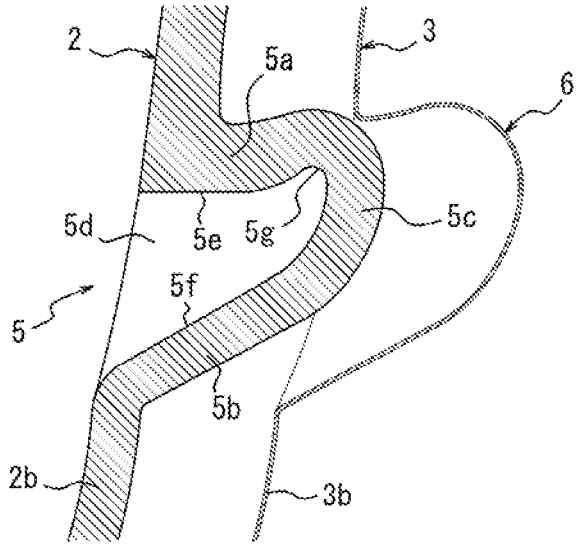
FIG. 3B is a sectional view taken along a line B-B in FIG. 1, illustrating a state of the inner layer body after being peeled.

By providing the outer layer body 2 with the outer-layer-side projecting portion 5 whose inner surface has the undercut shape, and by providing the inner layer body 3 with the inner-layer-side projecting portion 6 whose outer surface has the shape corresponding to the undercut shape of the outer-layer-side projecting portion 5, the following effect is achieved. That is to say, as illustrated in FIG. 3B, once the inner layer body 3 is peeled from the outer layer body 2, the inner-layer-side projecting portion 6 provided in the inner layer body 3 has difficulty fitting into the outer-layer-side projecting portion 5 provided in the outer layer body 2 again, and space is maintained between the outer-layer-side projecting portion 5 and the inner-layer-side projecting portion 6. When, for example, the blow molding of the peelable laminated container 1 is followed by shrinking the inner layer body 3 by suction with negative pressure to peel the entire inner layer body 3 from the outer layer body 2, and subsequently by pumping air to the inside of the inner layer body 3, the space is maintained between the outer-layer-side projecting portion 5 and the inner-layer-side projecting portion 6 while the remaining portion of the inner layer body 3 is closely joined to the inner surface of the outer layer body 2. Accordingly, at the time of dispensing the content contained in the inner layer 3 through the dispensing spout 2*a*, the space maintained between the outer-layer-side projecting portion 5 and the inner-layer-side projecting portion 6 serves as an air flow path which allows the ambient air introduced from the air inlet hole 4 to easily flow between the outer layer body 2 and the inner layer body 3 even in a portion of the trunk portion 2*b* that is located near the bottom portion 2*c*. This facilitates the peeling of the inner layer body 3 from the outer layer body 2 and prevents the peeling failure of the inner layer body 3 and the deformation of the outer layer body 2 in the peelable laminated container 1.

Figure 4:
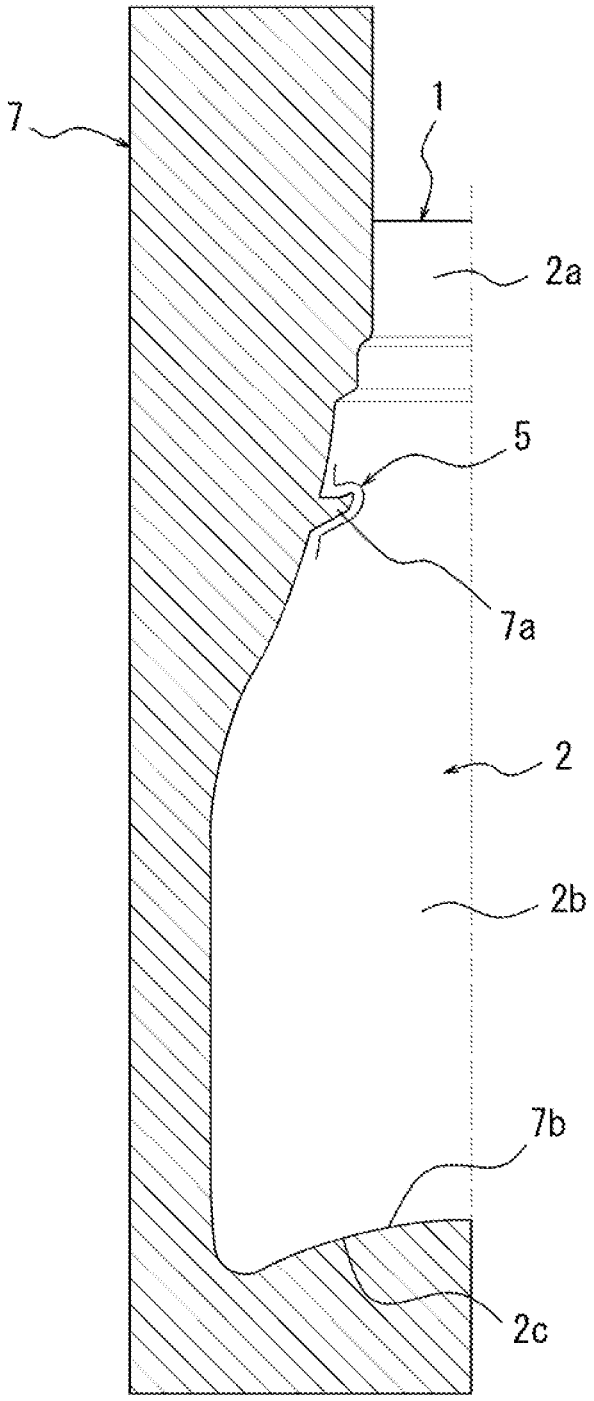
FIG. 4 is a sectional view schematically illustrating a state where the peelable laminated container of FIG. 1 is blow molded with a metal mold.
Figure 5:
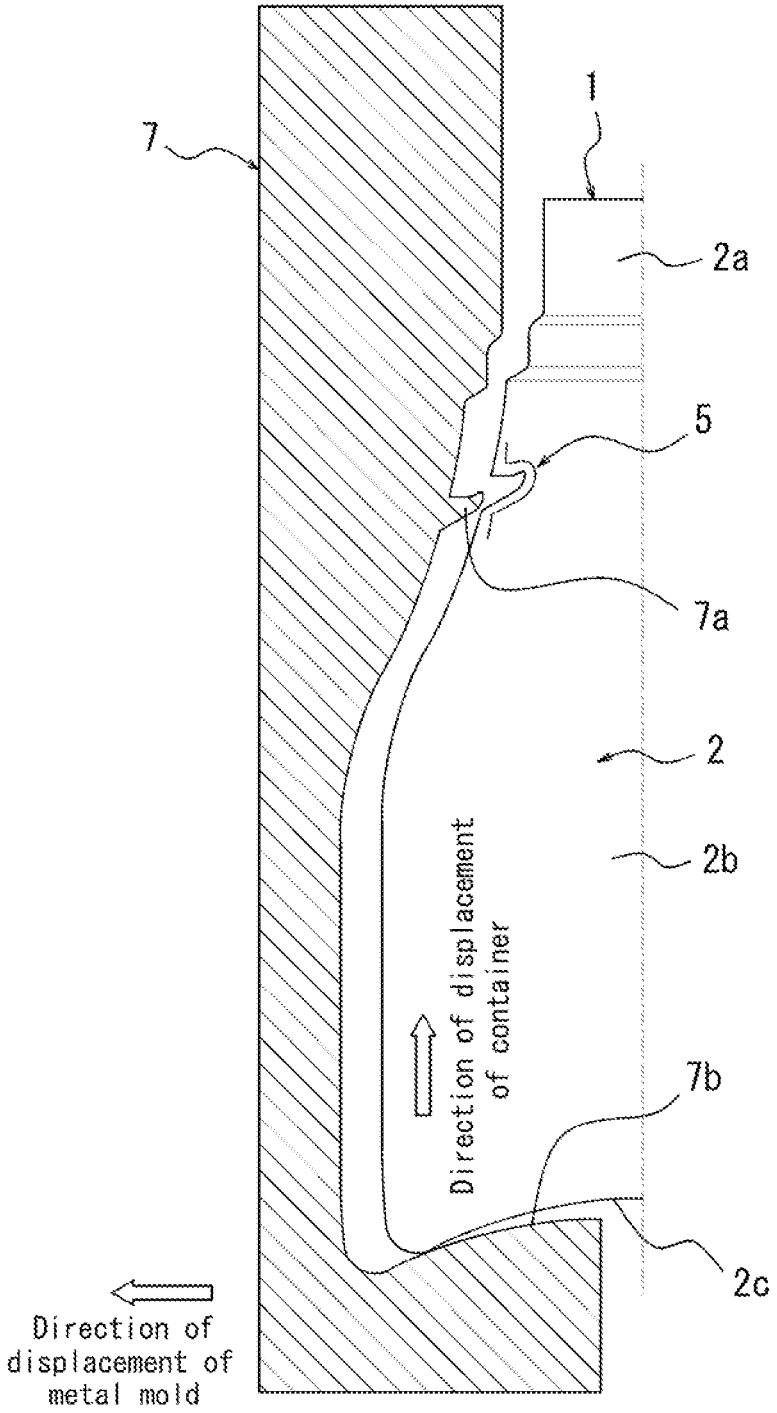
FIG. 5 is a sectional view schematically illustrating how the peelable laminated container is removed from the metal mold after the blow molding as illustrated in FIG. 4.

As described above, the outer surface of the outer-layer-side projecting portion 5 provided in the outer layer body 2 is formed in the undercut shape including the flat surface 5*e* that is perpendicular to the axis of the dispensing spout 2*a*, the inclined surface 5*f* that is inclined closer to the dispensing spout 2*a* as the inclined surface 5*f* extends further inward of the trunk portion 2*b*, and the cut-out surface 5*g* that is depressed toward the dispensing spout 2*a* relative to the flat surface 5*e*. The above configuration makes it easy to impart the undercut shape to the inner surface of the outer-layer-side projecting portion 5 during the blow molding of the peelable laminated container 1 with the metal mold. In detail, as illustrated in FIG. 4, by providing, in a metal mold 7 used for the blow molding, a convex portion 7*a* having the undercut shape corresponding to the outer surface of the outer-layer-side projecting portion 5 and by blow molding the laminated parison with the metal mold 7, the outer-layer-side projecting portion 5 having the undercut shape is easily formed. Since the bottom portion 2*c* of the peelable laminated container 1 is formed in the concave shape, as illustrated in FIG. 5, after the blow molding, the metal mold 7 may be opened about a hinge axis (which is not illustrated) extending along the vertical direction thereof, that is to say, along the axis of the dispensing spout 2*a*, and the peelable laminated container 1 may be removed from the metal mold 7 by displacing the container 1 upward by moving the bottom portion 2*c* along a bottom surface 7*b* of the metal mold 7. In the present embodiment, since the outer surface of the outer-layer-side projecting portion 5 is formed in the undercut shape extending toward the dispensing spout 2*a*, that is to say, upward, and the flat surface 5*e*, which defines the outer surface of the upper wall 5*a* of the outer-layer-side projecting portion 5, is formed perpendicularly to the axis direction of the dispensing spout 2*a*, and the inclined surface 5*f* of the lower wall 5*b* is formed inclined closer to the dispensing spout 2*a* as the inclined surface 5*f* extends further inward of the trunk portion 2*b*, the outer-layer-side projecting portion 5 may be separated from the convex portion 7*a* provided in the metal mold 7 easily after the blow molding. Thus, the peelable laminated container 1 is easily removed from the metal mold 7.

Figure 6:
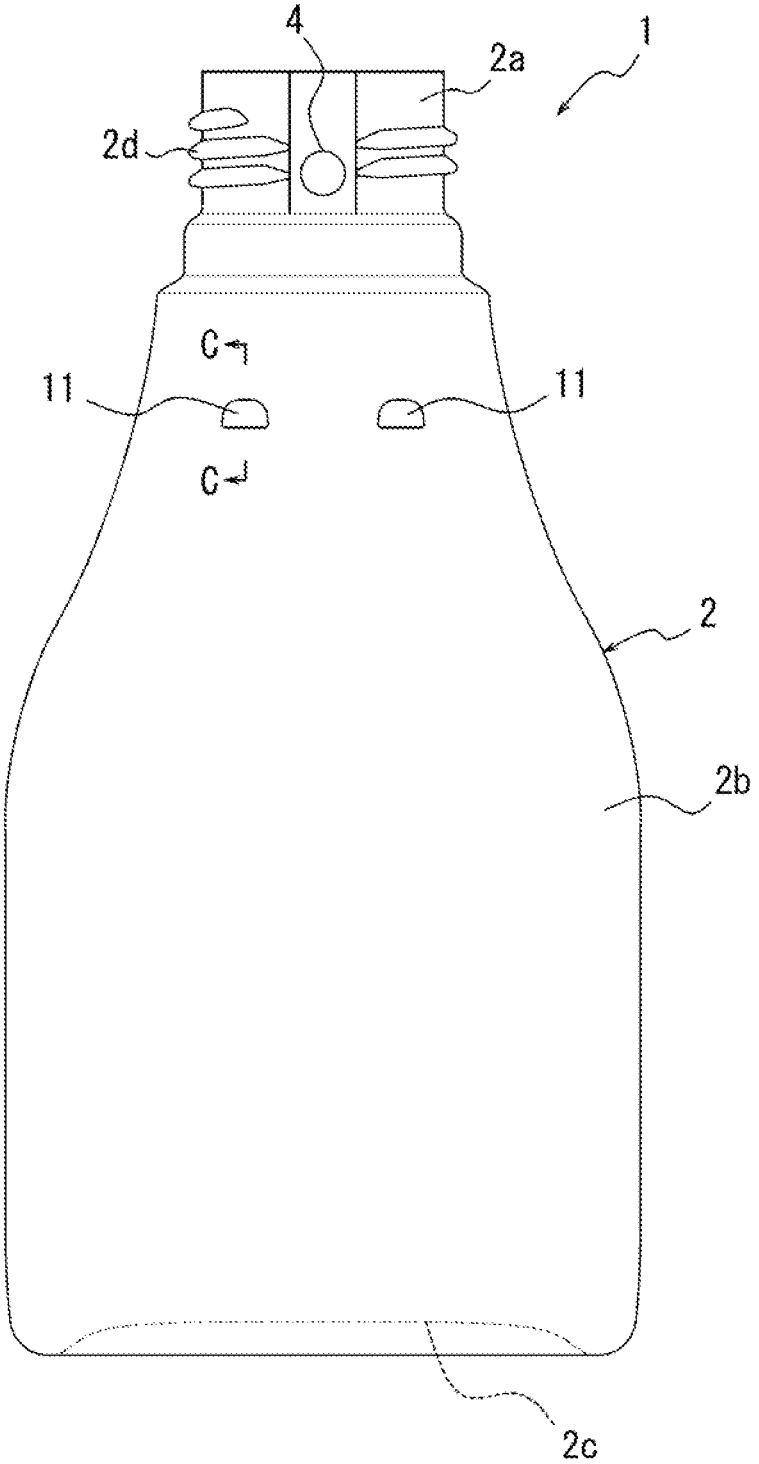
FIG. 6 is a front view of a peelable laminated container according to another embodiment of the present invention.

FIG. 6 is a front view of a peelable laminated container according to another embodiment of the double container of the present invention. In FIG. 6, members substantially the same as those described above are denoted by the same reference numerals.

The peelable laminated container 1 of FIG. 6 differs from the peelable laminated container 1 of FIG. 1 in that the level of raise of the bottom portion 2*c* is lower and in that an outer-layer-side projecting portion 11 has a different shape as described below.

As illustrated in FIG. 7, the outer-layer-side projecting portion 11 of the peelable laminated container 1 projects toward the inner layer body 3, that is to say, toward the inside of the peelable laminated container 1 relative to the outer circumferential surface of the outer layer body 2. The appearance of the outer-layer-side projecting portion 11 is in a concave shape that is depressed inward relative to the outer circumferential surface of the outer layer body 2. The outer-layer-side projecting portion 11 includes a lower wall 11*a* and an upper wall 11*b*. The lower wall 11*a* extends perpendicularly to the axis of the dispensing spout 2*a*, and the upper wall 11*b* is formed in a concave shape that connects to an inner end of the lower wall 11*a* and the outer circumferential surface of the outer layer body 2. The lower wall 11*a* has an outer surface defined as a flat surface 11*c* that is perpendicular to the axis of the dispensing spout 2*a*, and the upper wall has an outer surface defined as a concave curved surface 11*d* that is located above the flat surface 11*c* of the lower wall 11*a*, that is to say, closer to the dispensing spout 2*a*, and that connects to the flat surface 11*c*.

In this peelable laminated container 1 also, the inner surface of the outer-layer-side projecting portion 11 that faces to the side of the inner layer body 3 has an undercut shape in the longitudinal section in the direction along the axis of the dispensing spout 2*a*. In the present embodiment, a portion of the outer-layer-side projecting portion 11 that is located around a junction between an inner surface of the lower wall 11*a* and the outer circumferential surface of the outer layer body 2 has an undercut shape that is depressed upward, that is to say, toward the dispensing spout 2*a*. In the direction that is perpendicular to the inner surface of the outer layer body 2, that is to say, the direction in which the inner layer body 3 is peeled from the outer layer body 2, relative to the remaining portion of the lower wall 11*a*.

Figure 8:
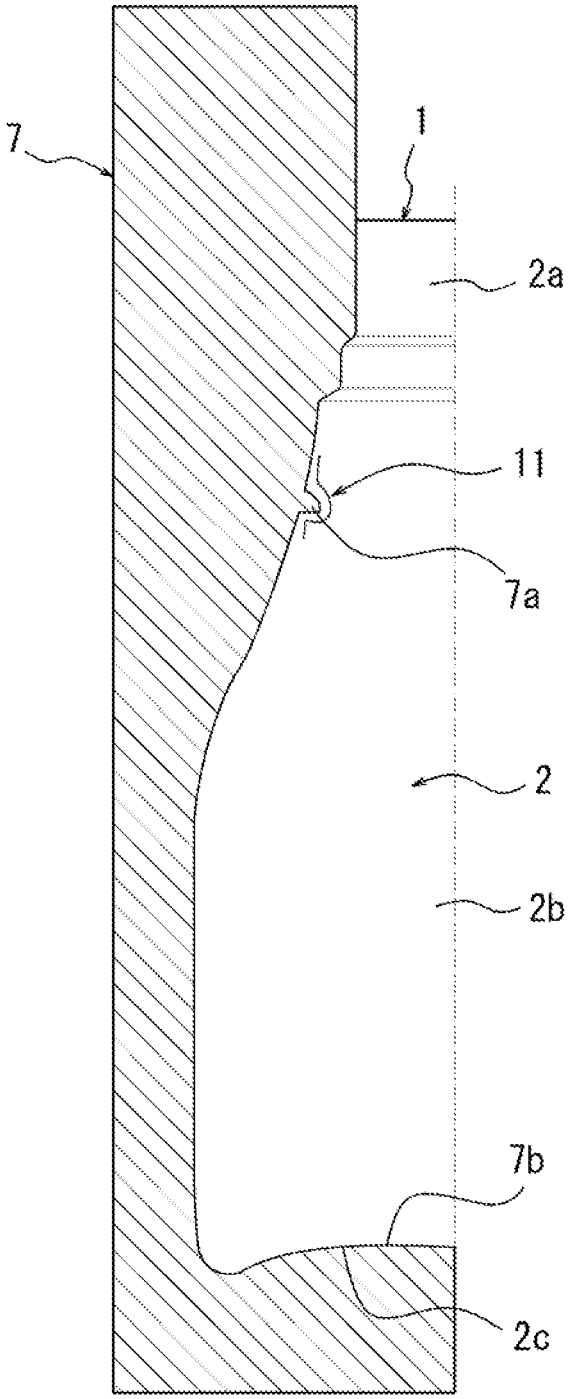
FIG. 8 is a sectional view schematically illustrating a state where the peelable laminated container of FIG. 6 is blow molded with a metal mold.

As illustrated in FIG. 8, by providing, in the metal mold 7 used for the blow molding, the convex portion 7*a* having the undercut shape corresponding to the outer surface of the outer-layer-side projecting portion 11, the undercut shape is easily imparted to the inner surface of the outer-layer-side projecting portion 11 with the metal mold 7.

Furthermore, since the outer surface of the upper wall 11*b* is defined as the curved surface 11*d*, during the blow molding, the laminated parison may be blow molded in accordance with the shape of the metal mold to impart a deeper undercut shape to the junction between the lower wall 11*a* and the inner surface of the outer layer body 2.

Figure 7A:
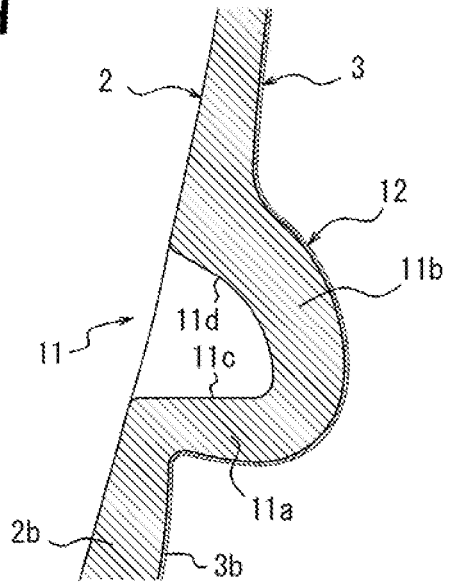
FIG. 7A is a sectional view taken along a line C-C in FIG. 6, illustrating a state of an inner layer body before being peeled.

In correspondence with the outer-layer-side projecting portion 11, inner-layer-side projecting portion 12 is provided in the inner layer body 3. The inner-layer-side projecting portion 12 projects from the outer circumferential surface of the inner layer body 3 toward the inside of the inner layer body 3. The inner-layer-side projecting portion 12, in the longitudinal section, has a shape that corresponds to the inner surface of the outer-layer-side projecting portion 11. The outer surface of the inner-layer-side projecting portion 12 has a shape that is substantially the same as the shape of the inner surface of the outer-layer-side projecting portion 11. As illustrated in FIG. 7A, after the blow molding, the outer surface of the inner-layer-side projecting portion 12 is closely joined to the inner surface of the outer-layer-side projecting portion 11.

Figure 7B:
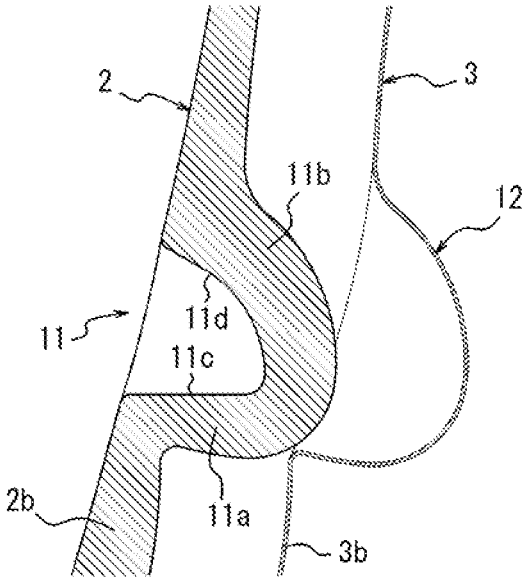
FIG. 7B is a sectional view taken along a line C-C in FIG. 6, illustrating a state of the inner layer body after being peeled.

Accordingly, the similar effect is also achieved in this peelable laminated container 1. That is to say, as illustrated in FIG. 7B, once the inner layer body 3 is peeled from the outer layer body 2, the inner-layer-side projecting portion 12 provided in the inner layer body 3 has difficulty fitting into the outer-layer-side projecting portion 11 provided in the outer layer body 2 again, and space is maintained between the outer-layer-side projecting portion 11 and the inner-layer-side projecting portion 12.

Figure 9:
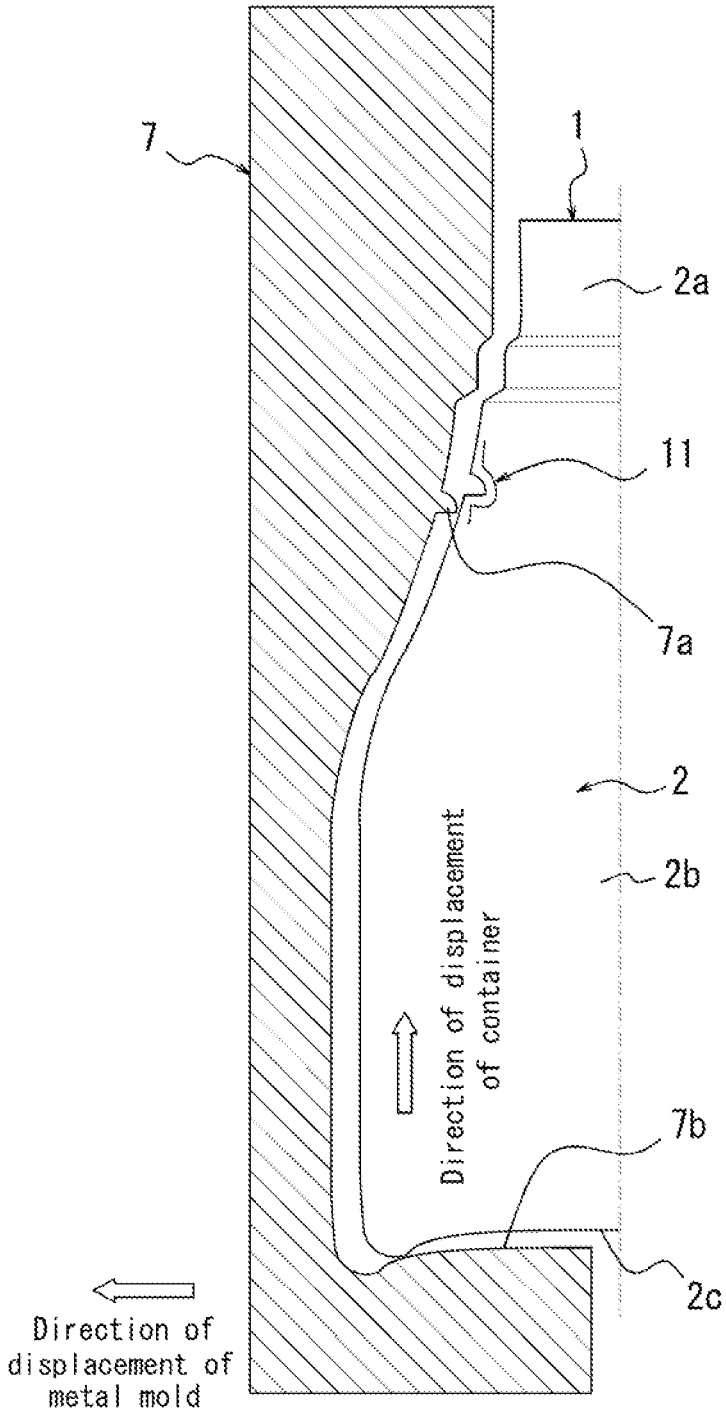
FIG. 9 is a sectional view schematically illustrating how the peelable laminated container is removed from the metal mold after the blow molding as illustrated in FIG. 8.

As illustrated in FIG. 8, the peelable laminated container 1 is also configured by blow molding the laminated parison with the metal mold 7 provided with the convex portion 7*a* used for forming the outer-layer-side projecting portion 11. In the present embodiment, since the level of raise of the bottom portion 2*c* of the peelable laminated container 1 is lower than that of the peelable laminated container 1 of FIG. 1, as illustrated in FIG. 9, even with the outer surface of the lower wall 11*a* being defined as the flat surface 11*c* that is perpendicular to the axis of the dispensing spout 2*a*, the outer-layer-side projecting portion 11 may be separated from the convex portion 7*b* provided in the metal mold 7 easily after the blow molding. Thus, the peelable laminated container 1 is easily removed from the metal mold 7.

Figure 10:
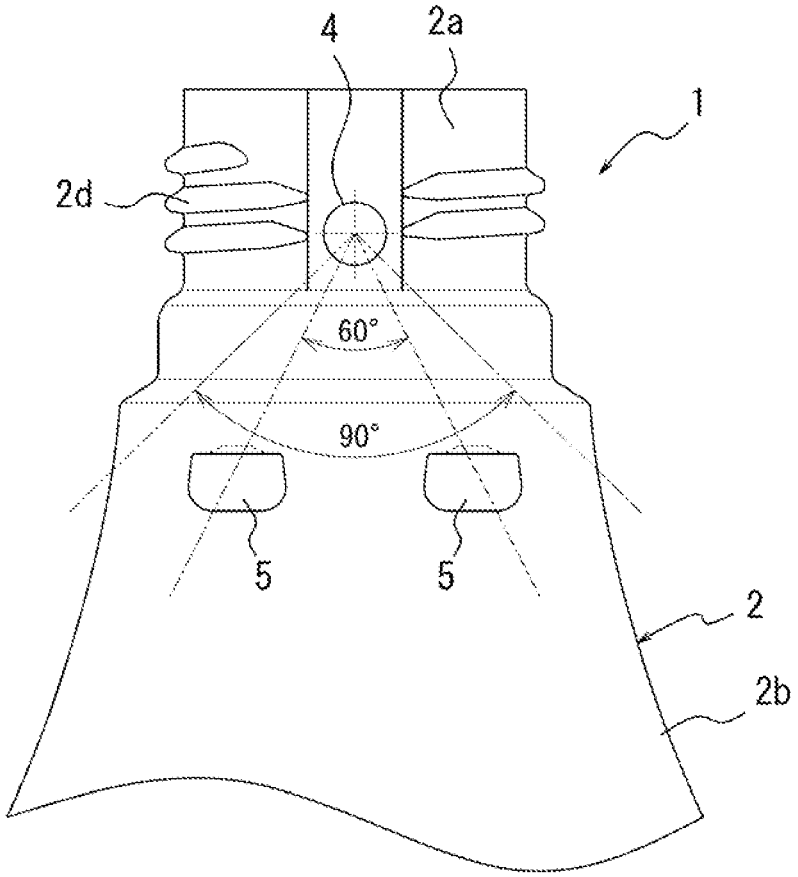
FIG. 10 is a partially cut-away front view of a peelable laminated container for illustrating a modified example of the arrangement of outer-layer-side projecting portions in FIG. 1.

FIG. 10 is a partially cut-away front view of a double container for illustrating a modified example of the arrangement of the outer-layer-side projecting portions of FIG. 1.

In the modified example of FIG. 10, portions of the two outer-layer-side projecting portions 5 provided in the outer surface of the outer layer body 2 are arranged in a range from 60 degrees or more to 90 degrees or less from an axis of the air inlet hole 4 downward in a direction that passes the center of the air inlet hole 4 and that is parallel to the axis of the dispensing spout 2*a*, in a plan view seen from an axis direction of the air inlet hole 4.

When the inner layer body 3 is joined to the outer layer body 2 again after being temporarily peeled from the outer layer body 2 after the blow molding as described above, the inner layer body 3 closely joined to the outer layer body 2 is creased around the air inlet hole 4 provided in the dispensing spout 2*a*, and space of the creases arises between the outer layer body 2 and the inner layer body 3 in a direction from the air inlet hole 4 to the trunk portion 2*b*. Such space often arises in the range from 60 degrees to 90 degrees from the axis of the air inlet hole 4 in the direction toward the trunk portion 2*b*. Accordingly, arranging the outer-layer-side projecting portions 5 in the aforementioned range allows the space of the creases arising around the air inlet hole 4 to communicate with the space maintained between the outer-layer-side projecting portions 5 and the inner-layer-side projecting portions, thereby further ensuring the presence of the air flow path between the air inlet hole 4 and the trunk portion 2*b*. In the illustrated example, the portions of the outer-layer-side projecting portions 5 are arranged in the range from 60 degrees or more to 90 degrees or less from the axis of the air inlet hole 4 in the direction that passes the center of the air inlet hole 4 and that is parallel to the axis of the dispensing spout 2*a*. However, any other arrangement may be possible if only at least portions of the outer-layer-side projecting portions 5 are arranged in the aforementioned range so that the communication flow path may be formed between the air inlet hole 4 and the trunk portion 2*b*. For example, the entire outer-layer-side projecting portions 5 may be arranged in the aforementioned range.

Needless to say, the present invention is not limited to the above embodiments, and various changes may be made without departing the gist of the present invention. For example, although in the above embodiments the dispensing spout 2*a* is provided with the single air inlet hole 4, and the outer layer body 2 is provided with the pair of outer-layer-side projecting portions 5, 11 in correspondence with the air inlet hole 4, the dispensing spout 2*a* may be provided with a plurality of air inlet holes 4, and the outer layer body 2 may be provided with a plurality of pairs of outer-layer-side projecting portions 5, 11 in correspondence with the air inlet holes 4. Alternatively, the dispensing spout 2*a* may be provided with a plurality of air inlet holes 4, and the outer layer body 2 may be provided with the outer-layer-side projecting portions 5, 11 in correspondence with at least one of the air inlet holes 4.

Furthermore, the outer surfaces of the outer-layer-side projecting portions 5, 11 may have any other shapes that allow the undercut shapes to be imparted to the inner surfaces of the outer-layer-side projecting portions 5, 11 in the longitudinal sections.

Moreover, the outer-layer-side projecting portions 5, 11 do not need to be shaped to project toward the inner layer body 3 relative to the outer layer body 2 and may be shaped to project outward, that is to say, toward the opposite side to the inner layer body 3 relative to the outer layer body 2.

Moreover, the double container of the present invention is not limited to the peelable laminated container 1 including the outer layer body 2 and the inner layer body 3 that are integrally configured by blow molding the laminated parison. The double container may also be configured by forming the outer layer body 2 and the inner layer body 3 separately and subsequently incorporating the inner layer body 3 into the outer layer body 2.

With reference to FIGS. 11 to 14, the peelable laminated container 1 according to yet another embodiment of the present invention will be described below. In FIGS. 11 to 14, members corresponding to those described above are denoted by the same reference numerals.

Figure 11:
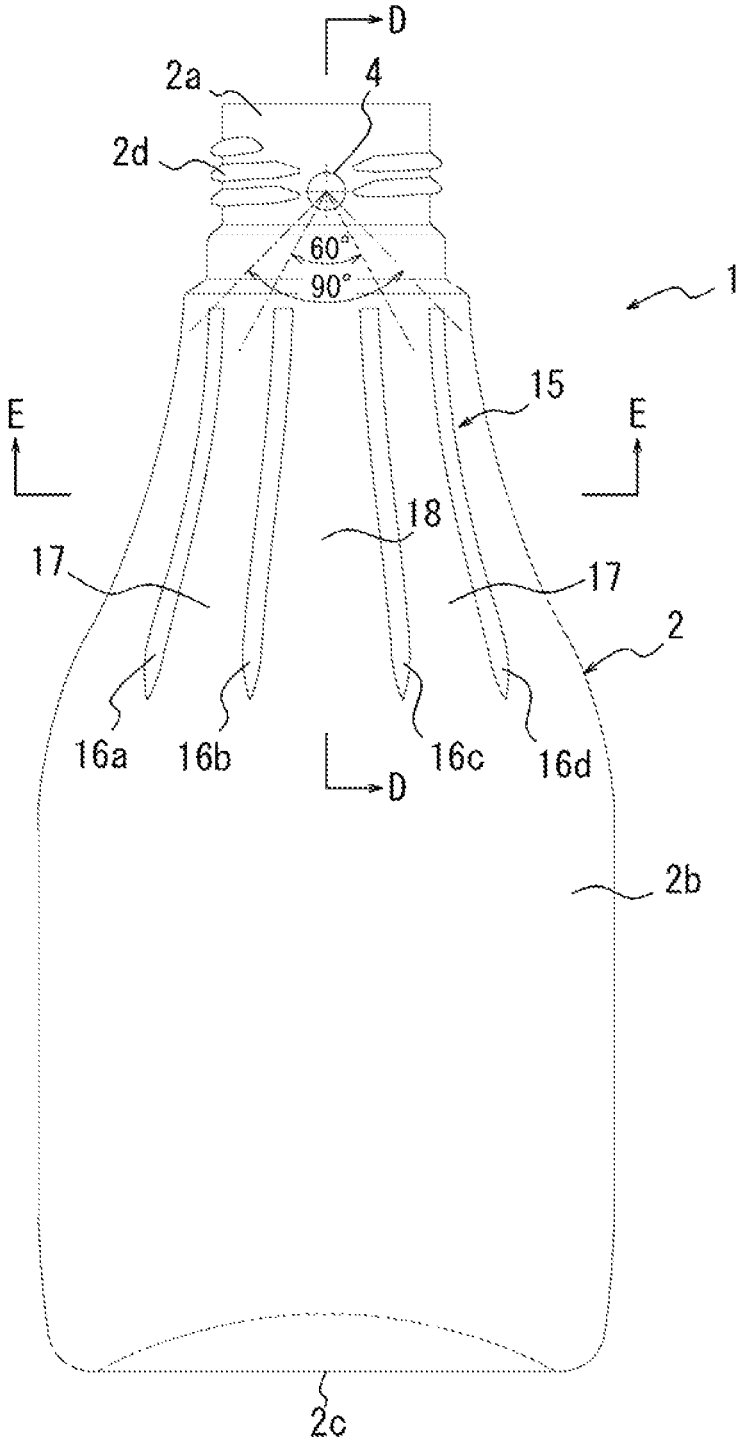
FIG. 11 is a front view of a peelable laminated container according to yet another embodiment of the present invention.
Figure 12:
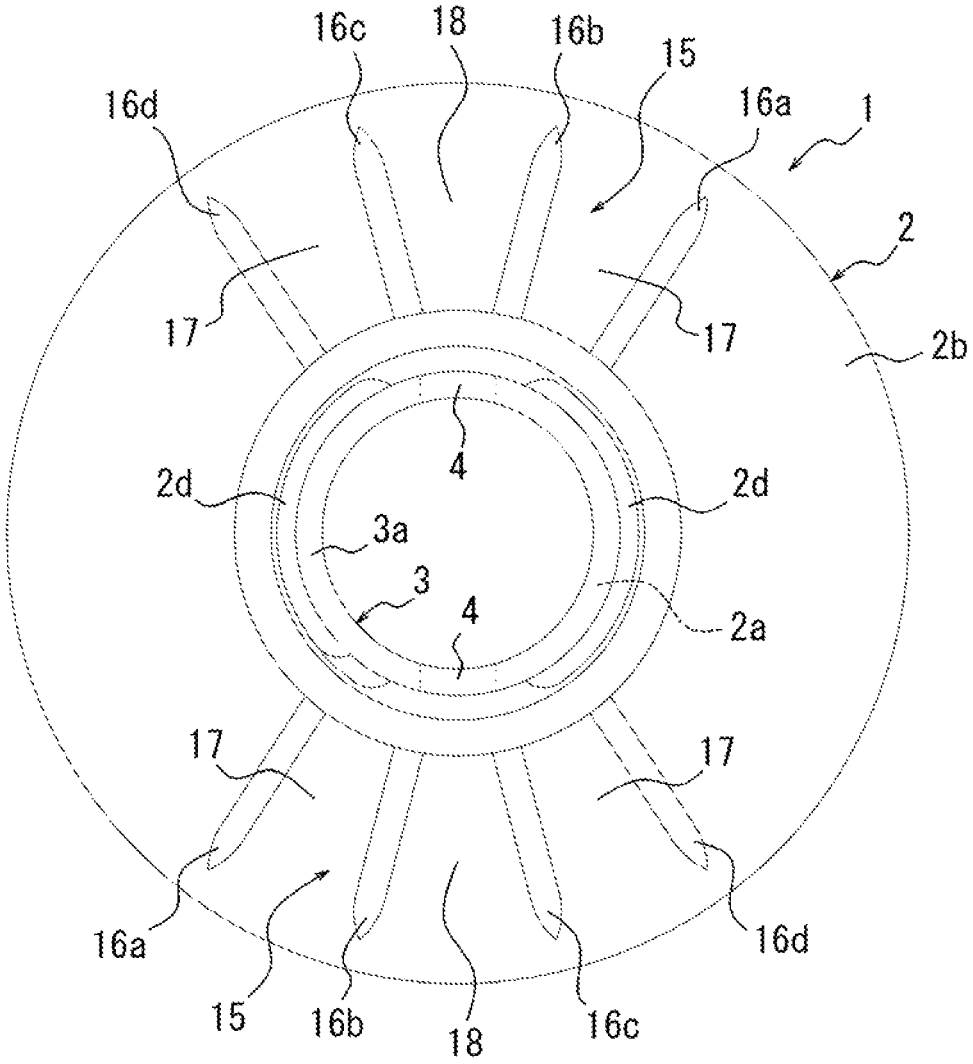
FIG. 12 is a plan view of the peelable laminated container of FIG. 11.
Figure 13:
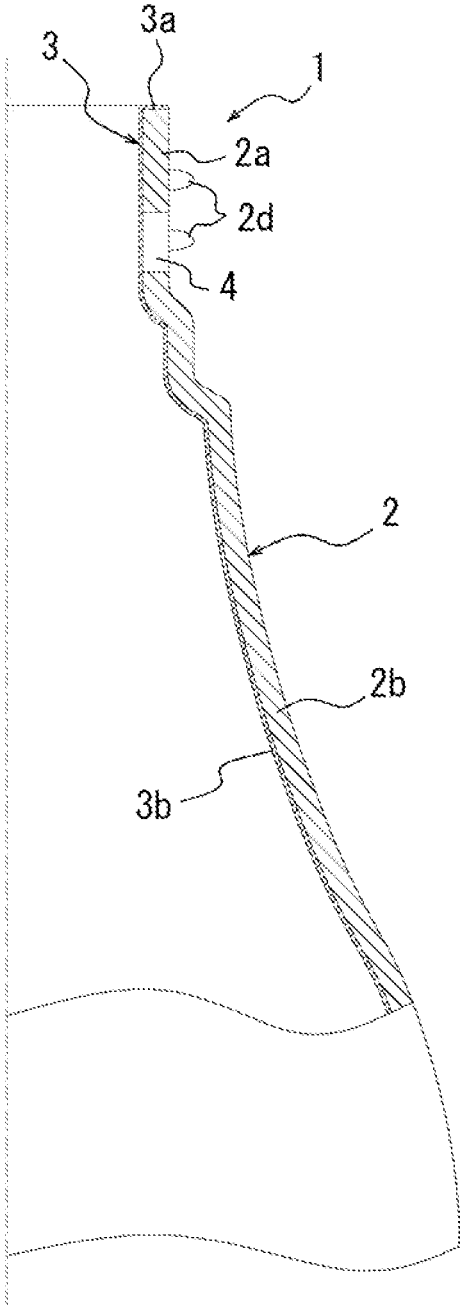
FIG. 13 is a sectional view taken along a line D-D in FIG. 11.

As illustrated in FIGS. 11 and 12, the outer layer body 2 includes the pair of air inlet holes 4 that are arranged symmetrically about the axis line of the dispensing spout 2*a*. The outer layer body 2 also includes the trunk portion 2*b* that is provided with a pair of rib sets 15 for facilitating the peeling of the inner layer body 3 from the outer layer body 2 at the time of dispensing the content. One of the pair of rib sets 15 is arranged in an area of the trunk portion 2*b* that is located below the corresponding one of the pair of air inlet holes 4, and the other one of the pair of rib sets 15 is arranged in an area of the trunk portion 2*b* that is located below the corresponding other one of the pair of air inlet holes 4. These two rib sets 15 have substantially the same structure, and a description is given below only of one of the rib sets 15.

The rib set 15 includes four concave grooves 16*a* to 16*d* that extend in a direction from the dispensing spout 2*a* to the bottom portion 2*c* in the outer layer body 2 and that are arranged circumferentially side by side. These concave grooves 16*a* to 16*d* each form a concave rib that is depressed inward relative to the outer circumferential surface of the outer layer body 2.

The circumferentially outermost concave groove 16*a* and the adjacent inner concave groove 16*b* form an outer layer rib 17 therebetween, and the circumferentially outermost concave groove 16*d* and the adjacent inner concave groove 16*c* also form an outer layer rib 17 therebetween. The pair of the inner concave grooves 16*b*, 16*c* forms a sub-outer layer rib 18 therebetween. Similarly to the concave grooves 16*a*, 16*d*, the pair of outer layer ribs 17 and the sub-outer layer rib 18 extends in the direction from the dispensing spout 2*a* to the bottom portion 2*c*, and these ribs 17, 18 are adjacent to each other via the concave grooves 16*b*, 16*c*. The outer layer ribs 17, which are adjacently located on both sides of the sub-outer layer rib 18, have shapes that are symmetrical about the sub-outer layer rib 18.

Figure 14:
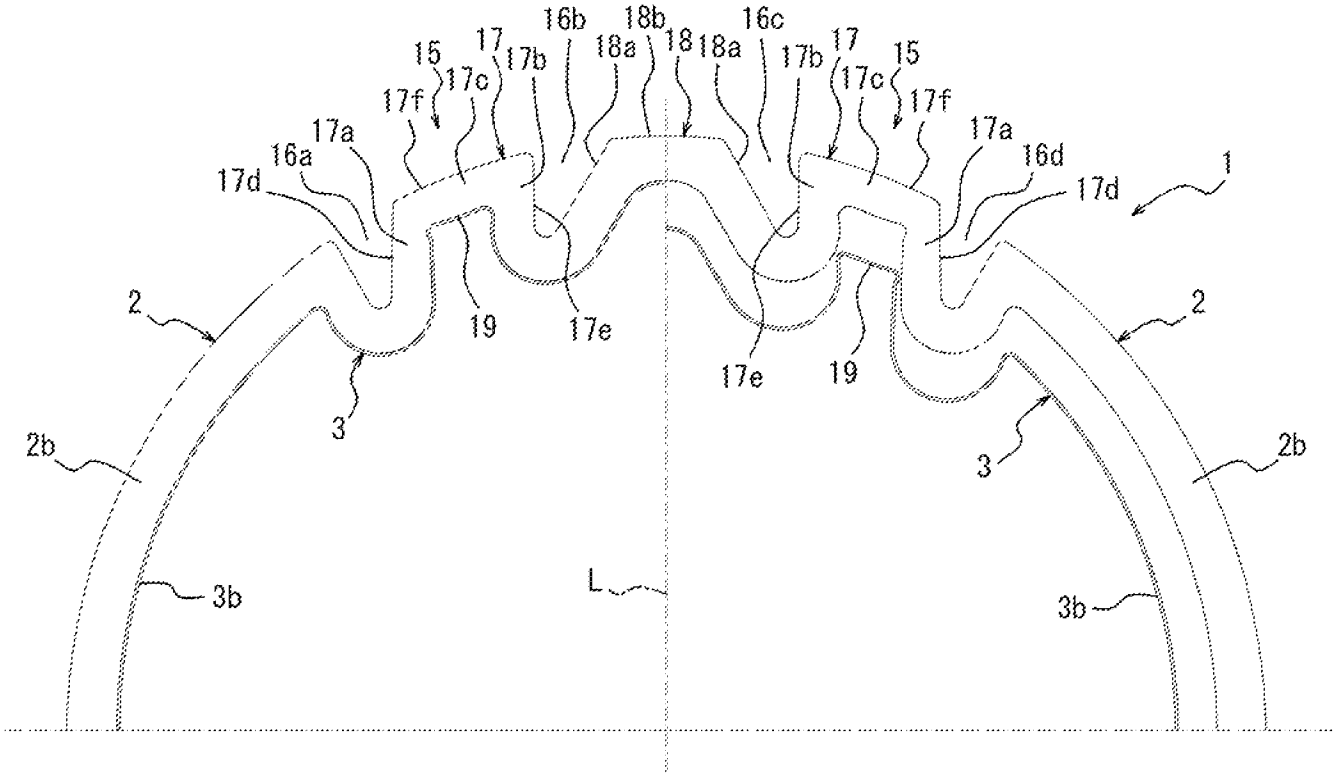
FIG. 14 is a sectional view taken along a line E-E in FIG. 11, with the left half of the figure illustrating a state during blow molding, and the right half of the figure illustrating a state after peeling.

FIG. 14 is a sectional view taken along a line E-E in FIG. 11, with the left half of the figure illustrating a state during the blow molding, and the right half of the figure illustrating a state after the peeling of the inner layer body from the outer layer body. In FIG. 14, the rib set 15 is partitioned by a line L into halves each representing the rib set 15 during the blow molding and the rib set 15 after the peeling, and the remaining portions having symmetrical shapes about the line L are omitted.

As illustrated in FIG. 14, the outer layer rib 17 formed on the outer layer body 2 includes a side wall portion 17*a*, a side wall portion 17*b* that is arranged circumferentially with respect to the side wall portion 17*a* on the side of the sub-outer layer rib 18, and a ceiling wall portion 17*c* that connects the side wall portion 17*a* and the side wall portion 17*b*. The outer layer rib 17 has substantially a U-shape in the transverse section taken along a direction that is perpendicular to the longitudinal direction of the outer layer rib 17. The outer surface of the outer layer rib 17 that faces to the opposite side to the inner layer body 3, that is to say, faces to the outside of the container, is formed to be flat in the side wall portions 17*a*, 17*b* and is also formed to be curved in the ceiling wall portion 17*c* in correspondence with the outer circumferential surface of the trunk portion 2*b*. Accordingly, in its transverse section, the outer surface of the outer layer rib 17 has a shape including a pair of outer surfaces of the side wall portions 17*a*, 17*b* having linear portions 17*d*, 17*e* which is in parallel with each other, and an arch-shaped outer surface of the ceiling wall portion 17*c* having a connecting side portion 17*f* which connects the pair of linear portions 17*d*, 17*e*. The linear portions 17*d*, 17*e* are each inclined inward toward the sub-outer layer rib 18 relative to a direction that passes a circumferential midpoint of the connecting side portion 17*f* and that is perpendicular to the connecting side portion 17*f* in the transverse section. In the illustrated example, the linear portions 17*d*, 17*e* extend in parallel with the line L that passes a widthwise middle point of the sub-outer layer rib 18 and that also passes the axis of the dispensing spout 2*a*. Although in the present embodiment the linear portions 17*d*, 17*e* are in parallel with each other, the linear portions 17*d*, 17*e* may be arranged substantially in parallel but are at a slight angle with each other if only the outer layer rib 17 does not need to be subjected to forced extraction from the metal mold at the time of removing the peelable laminated container 1 from the metal mold after the blow molding with the metal mold. The linear portions 17*d*, 17*e* may also be disposed in an angled arrangement at a greater angle with each other than the case of the substantially parallel arrangement.

In its transverse section, an outer surface of the sub-outer layer rib 18 that faces to the opposite side to the inner layer body 3 has a shape including a pair of inclined sides 18*a*, which connects to the linear portions 17*e* of the outer layer rib 17 and which is inclined at an even greater angle than the linear portions 17*e* with respect to a radial direction thereof, and an arc side 18*b*, which connects the inclined sides 18*a*. The arc side 18*b* has an arch shape that corresponds to the outer circumferential surface of the outer layer body 2. With the above configuration, the sub-outer layer rib 18 has a trapezoid shape in its transverse section. The linear portions 17*e* of the outer layer rib 17 and the inclined sides 18*a* of the sub-outer layer rib 18 constitute inner surfaces of the concave grooves 16*b*, 16*c* that each have substantially a triangle shape in the transverse section.

On the other hand, as illustrated in FIG. 14, the inner surface of the outer layer rib 17 that faces to the side of the inner layer body 3, in the transverse section, has a shape whose corner portions are formed in an undercut shape. In the illustrated example, the outer layer rib 17 has the undercut shape in which the circumferentially extending width dimension of the inner surface of the ceiling wall portion 17*c* is greater than the circumferentially extending width dimension of the narrowest distance between the inner surface of one side wall portion 17*a* and the inner surface of the other side wall portion 17*b*.

In correspondence with the outer layer ribs 17, two inner layer ribs 19 are provided in the inner layer body 3. Each of the inner layer ribs 19 has, in the transverse section, a shape that corresponds to the transverse sectional shape of the inner surface of the outer layer rib 17. After the blow molding, as illustrated in the left half of FIG. 14, the outer surface of the inner layer rib 19 is closely joined to the inner surface of the outer layer rib 17. That is to say, at least a radially outer end portion of the inner layer rib 19 is formed in a shape whose width is gradually increased toward a tip portion located radially outward of the outer end portion, in correspondence with the undercut shape of the inner surface of the outer layer rib 17.

By providing the outer layer body 2 with the outer layer rib 17 whose inner surface has the undercut shape and by providing the inner layer body 3 with the inner layer rib 19 having the shape corresponding to the undercut shape of the outer layer rib 17, the following effect is achieved. That is to say, as illustrated in the right half of FIG. 14, once the inner layer body 3 is peeled from the outer layer body 2, the inner layer rib 19 provided in the inner layer body 3 has difficulty fitting into the outer layer rib 17 provided in the outer layer body 2 again, and space is maintained between the outer layer rib 17 and the inner layer rib 19. When, for example, the blow molding of the peelable laminated container 1 is followed by shrinking the inner layer body 3 by suction with negative pressure to peel the entire inner layer body 3 from the outer layer body 2, and subsequently by pumping air to the inside of the inner layer body 3, the space is maintained between the outer layer rib 17 and the inner layer rib 19 while the remaining portion of the inner layer body 3 is closely joined to the inner surface of the outer layer body 2. Accordingly, at the time of dispensing the content contained in the inner layer 3 through the dispensing spout 2*a*, the space maintained between the outer layer rib 17 and the inner layer rib 19 serves as an air flow path which allows the ambient air introduced from the air inlet hole 4 to easy flow between the outer layer body 2 and the inner layer body 3 even in a portion of the trunk portion 2*b* that is located near the bottom portion 2*c*. This facilitates the peeling of the inner layer body 3 from the outer layer body 2 and prevents the peeling failure of the inner layer body 3 and the deformation of the outer layer body 2 in the peelable laminated container 1.

As described previously, in its transverse section, the outer surface of the outer layer rib 17 formed in the outer layer body 2 has the shape including the pair of parallelly extending linear portions and the connecting side portion 17*f*. The above configuration makes it easy to impart the undercut shape to the inner surface of the outer layer rib 17 during the blow molding of the peelable laminated container 1 with the metal mold. In detail, since the outer surface of the outer layer rib 17, in the transverse section, has the shape including the pair of parallelly extending linear portions 17*d*, 17*e* and the connecting side portion 17*f*, the undercut shape is imparted to the inner surface of the outer layer rib 17 by stretching the laminated parison during the blow molding so that the area of the inner surface, i.e., the inner circumferential length, of the outer layer rib 17 will be increased and that the thicknesses of the corner portions around the junctions between the linear portions 17*d*, 17*e* and the connecting side portion will be further reduced.

Here, the linear portions 17*d*, 17*e* of the outer layer rib 17 are inclined relative to the direction that passes the midpoint of the connecting side portion 17*f* and that is perpendicular to the connecting side portion 17*f*, and the inclined sides 18*a* of the outer surface of the sub-outer layer rib 18 are inclined at even greater angles than the linear portions 17*e*. Accordingly, at the time of the blow molding with the metal mold, the laminated parison tends to flow more toward the inclined sides 18*a* of the sub-outer layer rib 18 than toward the linear portion 17*e*, i.e., to the side wall portion 17*b*, of the outer layer rib 17, allowing the laminated parison to be stretched further toward the corner portions connecting both the side wall portions 17*a*, 17*b* and the ceiling wall portion 17*c* of the outer layer rib 17 to reduce the thickness around the junction between the ceiling wall portion 17*c* and the side wall portion 17*b* of the outer layer rib 17. Consequently, the outer layer rib 17 is imparted with a deeper undercut shape in its transverse section. In addition, the inner layer body 3 is blow molded together with the outer layer body 2 during the blow molding of the laminated parison to be joined closely to the inner surface of the outer layer body 2. Accordingly, the inner layer body 3, along with the outer layer rib 17, is easily formed in the shape that corresponds to the undercut shape.

The blow molding uses the metal mold that may open about the hinge. The metal mold used in the blow molding of the present invention has the hinge axis that is positioned on a line that is perpendicular to the line L in FIG. 14 and that passes the axis of the peelable laminated container 1. Accordingly, even though the outer layer rib 17 has the shape including the pair of parallelly extending linear portions 17*d*, 17*e* and the connecting side portion 17*f* for imparting the undercut shape to the inner surface of the outer layer rib 17, the linear portions 17*d*, 17*e* extend in the mold opening direction about the hinge axis of the metal mold, and therefore, the peelable laminated container 1 is removed from the metal mold easily after the blow molding.

In the present embodiment, as illustrated in FIG. 11, longitudinal end portions of the outer layer ribs 17 that are located closer to the dispensing spout 2*a* are arranged in a range from 60 degrees or more to 90 degrees or less from the axis of the air inlet hole 4 toward the bottom portion 2*c*, that is to say, downward in the direction that passes the center of the air inlet hole 4 and that is parallel to the axis of the dispensing spout 2*a*, in the plan view seen from the axis direction of the air inlet hole 4.

When the inner layer body 3 is joined to the outer layer body 2 again after being temporarily peeled from the outer layer body 2 after the blow molding as described above, the inner layer body 3 closely joined to the outer layer body 2 is creased around the air inlet hole 4 of the dispensing spout 2*a*, and space of the creases arises between the outer layer body 2 and the inner layer body 3 in the direction from the air inlet hole 4 to the trunk portion 2*b*. Such space often arises in the range from 60 degrees to 90 degrees from the axis of the air inlet hole 4 in the direction toward the trunk portion 2*b*. Accordingly, arranging the longitudinal end portions of the outer layer ribs 17 in the aforementioned range allows the space of the creases arising around the air inlet hole 4 to communicate with the space maintained between the outer layer rib 17 and the inner layer rib 19, thereby further ensuring the presence of the air flow path between the air inlet hole 4 and the trunk portion 2*b*. In the illustrated example, the majority of the longitudinal end portions of the outer layer ribs 17 are arranged in the range from 60 degrees or more to 90 degrees or less in the direction that passes the center of the air inlet hole 4 and that is parallel to the axis of the dispensing spout 2*a*. However, any other arrangement may be possible if only at least portions of the outer layer ribs 17 are arranged in the aforementioned range so that the communication flow path is formed between the air inlet hole 4 and the trunk portion 2*b*. For example, only middle portions of the outer layer ribs 17 may be arranged in the aforementioned range.

Needless to say, the present invention is not limited to the above embodiment, and various changes may be made without departing the gist of the present invention. For example, although in the above embodiment the pair of air inlet holes 4 is arranged in the dispensing spout 2*a*, and the pair of rib sets 15 is arranged in the outer layer body 2 in correspondence with the pair of air inlet holes 4, the number of each of the air inlet hole 4 and the rib set 15 is not limited to two and may be one, or three or more. When a plurality of air inlet holes 4 are provided, it is only necessary to provide the rib set 15 in correspondence with at least one of the air inlet holes 4.

Furthermore, the outer surface of each outer layer rib 17 may have any other shape which allows the outer layer rib 17 to extend in the direction from the dispensing spout 2*a* to the bottom portion 2*c* and which imparts the undercut shape to the inner surface of the outer layer rib 17 in its transverse section.

Moreover, the outer layer ribs 17 are formed between the pair of concave grooves 16*a* to 16*d* formed in the outer circumferential surface of the outer layer body 2, with their ceiling wall portions 17*c* being flush with the outer circumferential surface of the outer layer body 2. However, the present invention is not limited to the above configuration, and the outer layer ribs 17 may or may not project outward from the outer circumferential surface of the outer layer body 2. Alternatively, the outer layer ribs 17 may be shaped to project from the outer circumferential surface of the outer layer body 2 toward the inner layer body 3.

Moreover, the double container of the present invention is not limited to the peelable laminated container 1 including the outer layer body 2 and the inner layer body 3 that are integrally formed by blow molding the laminated parison. The double container may also be configured by forming the outer layer body 2 and the inner layer body 3 separately and subsequently incorporating the inner layer body 3 into the outer layer body 2.

With reference to FIGS. 15 to 20, the peelable laminated container 1 according to yet another embodiment of the present invention will be described below. In FIGS. 15 to 20, members corresponding to those described above are denoted by the same reference numerals.

The peelable laminated container 1 (hereinafter, also called "container 1") according to the present embodiment includes the outer layer body 2 made of a flexible polyethylene resin and the inner layer body 3 made of a flexible nylon resin. The content may be dispensed by squeezing the trunk portion 2*b* in a state where a cap (which is not illustrated) including a check valve is attached to the dispensing spout (mouth portion) 2*a*. The container 1 is configured by blow molding, between the halves of the metal mold, the laminated cylindrical parison prepared by co-extruding the outer layer body 2 and the inner layer body 3.

The dispensing spout 2*a* includes an annular stepped portion 26, which is molded annually around the axis line O and which is reduced in diameter relative to an upper end portion of the trunk portion 2*b*, a cylindrical portion 27, which is further reduced in diameter relative to the annular stepped portion 26, and a mouth portion 28, which is even further reduced in diameter relative to the cylindrical portion 27. The cylindrical portion 27 is provided in an upper area thereof with a screw thread 30 for attachment of the aforementioned cap to the container 1. The cap member may also be attached by means of an undercut instead of the screw thread 30. Between the screw thread 30 and the annular stepped portion 26, two air inlet holes 4 are provided in opposing positions about the axis line O. The air inlet holes 4 each extend horizontally toward the axis line O to pass through the outer layer body 2, and the air inlet hole 4 has a circular shape.

The trunk portion 2*b* includes an upper area whose diameter is gradually increased in a downward direction from the upper end portion thereof, and a lower area which has substantially a cylindrical shape. The lower area also includes a transition portion extending toward the bottom portion 2*c* that is gradually reduced in diameter toward the bottom portion 2*c*.

Figure 15:
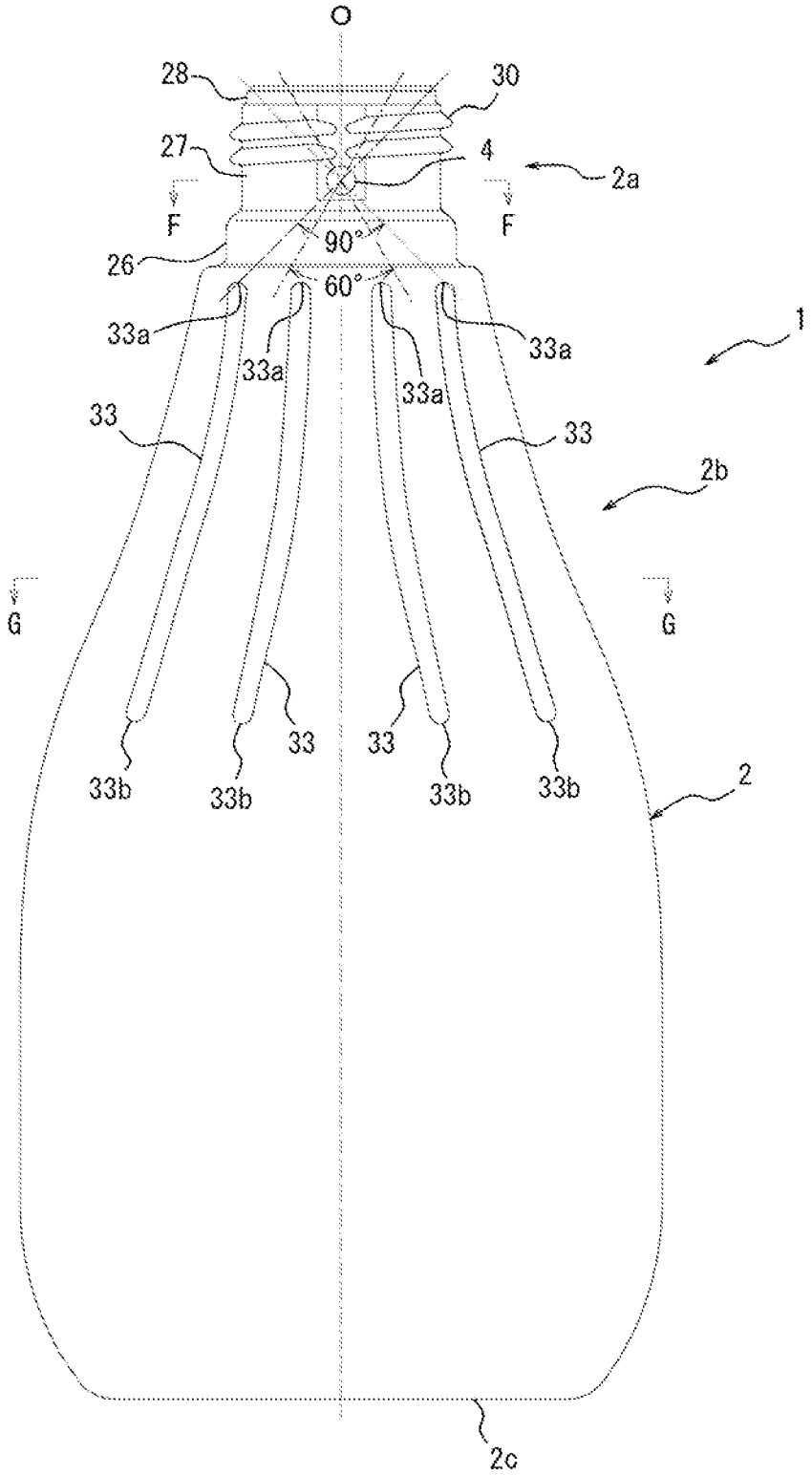
FIG. 15 is a side view of a peelable laminated container according to yet another embodiment of the present invention.
Figure 16A:
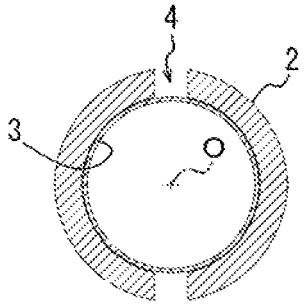
FIG. 16A is a sectional view taken along a line F-F in FIG. 15 before an initial peeling process.
Figure 16B:
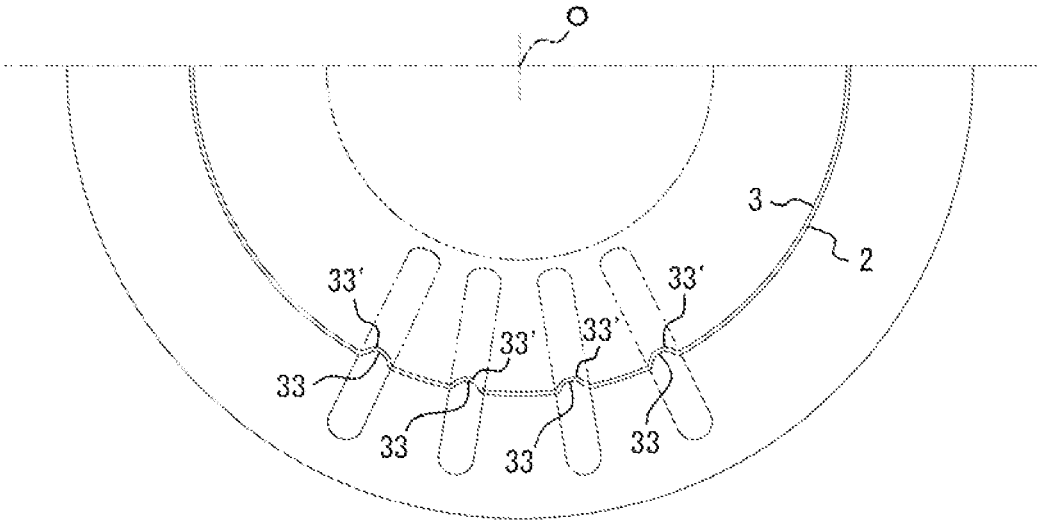
FIG. 16B is a sectional view taken along a line G-G in FIG. 15 before the initial peeling process.

In the upper area of the trunk portion 2*b*, four outer-layer-side longitudinal ribs 33, as the outer-layer-side projecting portions, are arranged at an equal interval on each of opposing sides. The outer-layer-side longitudinal ribs 33 each have a concave sectional shape. The total of eight outer-layer-side longitudinal ribs 33 each extend in the vertical direction (i.e., along a ridge line defining the appearance and shape of the trunk portion 2*b* when viewed from the side). Each outer-layer-side longitudinal rib 33 also includes an upper end 33*a* and a lower end 33*b*. The respective upper ends 33*a* are aligned at the same height, and the respective lower ends 33*b* are aligned at the same height. The section of the outer-layer-side longitudinal rib 33 is preferably but not limited to an arc shape. As for each of the outermost two outer-layer-side longitudinal ribs 33 as illustrated in FIG. 15, a line segment connecting the upper end 33*a* of the outer-layer-side longitudinal rib 33 and the air inlet hole 4 forms an angle of 45° with the axis line O. In addition, in the inner layer 3, inner-layer-side longitudinal ribs 33', as the inner-layer-side projecting portions, are arranged. The inner-layer-side longitudinal ribs 33' have shapes that correspond to the inner surfaces of the outer-layer-side longitudinal ribs 33.

Thus, in an area extending in the range of a central angle of 90° (in the range of 45° on both sides of the axis line O in FIG. 15) downward from the air inlet hole 4, at least one outer-layer-side longitudinal rib 33 is arranged. That is to say, at least one outer-layer-side longitudinal rib 33 is arranged on the lines representing 90° in FIG. 15 or on the extensions of these lines, or at least outer-layer-side longitudinal rib 33 is arranged in an area defined by the left-side and right-side lines representing 90° in FIG. 15 and by the extensions of these lines. Furthermore, in each of two areas, one each on left and right sides, determined by excluding the area extending in the range of a central angle of less than 60° (in the range of less than 30° on both sides of the axis line O in FIG. 15) downward from the air inlet hole 4, from the area extending in the range of a central angle of 90° downward from the air inlet hole 4, an outer-layer-side longitudinal rib 33 is arranged. Moreover, the two areas, one each on left and right sides, determined by excluding the area extending in the range of a central angle of less than 60° from the area extending in the range of a central angle of 90° downward from the air inlet hole 4, communicate to areas defined between two outer-layer-side longitudinal ribs 33 in pair.

The dispensing spout 2*a*, the trunk portion 2*b*, and the bottom portion 2*c* included in the container 1 shaped as described above, except for the portions of the air inlet holes 4, are configured by the outer layer body 2 and the inner layer body 3. The outer layer body 2 and the inner layer body 3 are joined closely to each other immediately after the blow molding. The container 1 in the above state then undergoes an initial peeling process of peeling the inner layer body 3 from the outer layer body 2 in advance to facilitate smooth peeling in use. In detail, firstly, a cylindrical air blowing member (which is not illustrated) is inserted into the air inlet hole 4, and air is blown. By doing so, air is introduced between the inner layer body 3 and the outer layer body 2, and the inner layer is peeled from the outer layer body 2. Subsequently, air is injected through the dispensing spout 2*a* to inflate the inner layer body 3. At this time, the air that has been introduced between the inner layer body 3 and the outer layer body 2 is discharged from the air inlet holes 4. The initial peeling process may also be performed by shrinking, after the blow molding, the inner layer body 3 by suction with negative pressure to peel the entire inner layer body 3 from the outer layer body 2 and subsequently pumping air to the inside of the inner layer body 3.

Figure 17A:
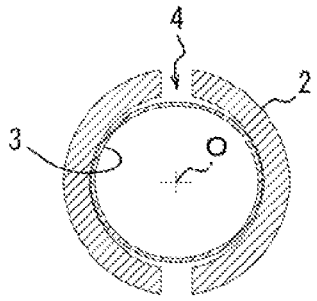
FIG. 17A is a sectional view taken along a line F-F in FIG. 15 after the initial peeling process.
Figure 17B:
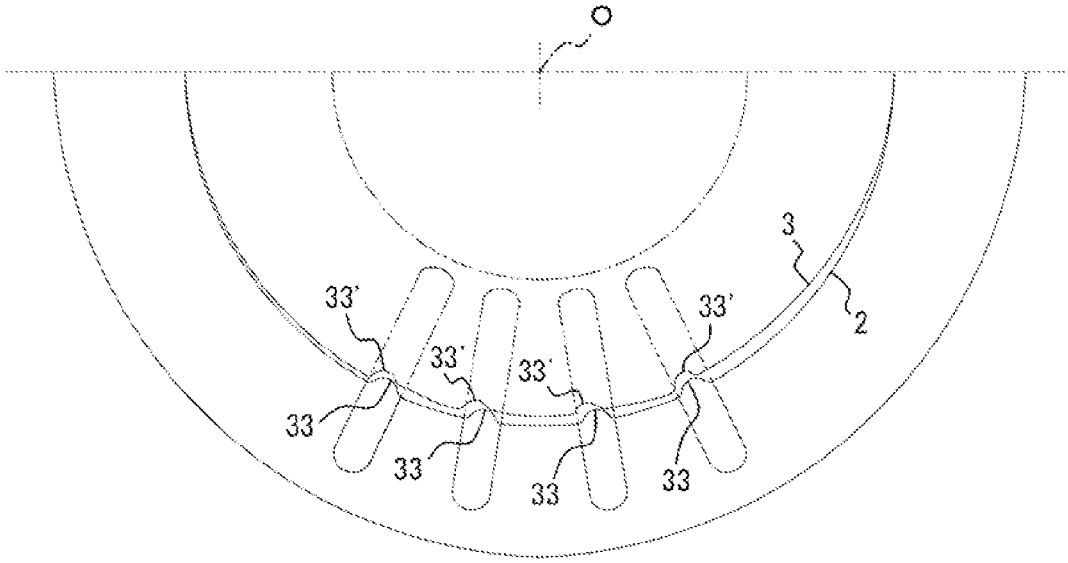
FIG. 17B is a sectional view taken along a line G-G in FIG. 15 after the initial peeling process.

At this time, due to the outer-layer-side longitudinal ribs 33 formed in the trunk portion 2*b*, the inner layer body 3 is prevented from being completely restored to the original shape. Accordingly, as illustrated in FIG. 17B, space is maintained between the inner layer body 3 and the outer layer body 2. In detail, when the inner layer body 3 is being restored to the original shape after being peeled, the inner layer body 3 is slightly misaligned with the outer layer body 2 in the circumferential direction. Accordingly, peripheral portions of the inner-layer-side longitudinal ribs 33' formed in the inner layer body 3 go up onto the outer-layer-side longitudinal ribs 33 formed in the outer layer body 2, and as a result, the space is maintained in peripheral areas of the outer-layer-side longitudinal ribs 33. In particular, the space is increased in the area defined between two adjacent outer-layer-side longitudinal ribs 33. Hence, as in the present example, it is most preferable that the two areas, one each on left and right sides, determined by excluding the area extending in the range of a central angle of less than 60° from the area extending in the range of a central angle of 90° downward from the air inlet hole 4, communicate to the areas defined between two outer-layer-side longitudinal ribs 33 in pair. This arrangement most reliably ensures that the ambient air introduction path (the space) maintained in the trunk portion 2*b* after the initial peeling process may communicate with the ambient air introduction path provided in the dispensing spout 2*a*.

Even without the above arrangement of the outer-layer-side longitudinal ribs 33, arranging at least one outer-layer-side longitudinal rib 33 in the area extending in the range of a central angle of 90° downward from the air inlet hole 4 may ensure that the ambient air introduction path maintained in the peripheral areas of the outer-layer-side longitudinal ribs 33 formed in the trunk portion 2*b* after the initial peeling process may communicate with the ambient air introduction path provided in the dispensing spout 2*a*. In this case, it is preferable that an outer-layer-side longitudinal rib 33 is arranged in each of two areas, one each on left and right sides, determined by excluding the area extending in the range of a central angle of less than 60° downward from the air inlet hole 4, from the area extending in the range of a central angle of 90° downward from the air inlet hole 4. This arrangement ensures that the ambient air introduction path maintained in the peripheral areas of the outer-layer-side longitudinal ribs 33 may communicate with the ambient air introduction path provided in the dispensing spout 2*a*. In this case, as in the present embodiment, it is more preferable that an additional outer-layer-side longitudinal rib 33 is arranged in the area of a central angle of less than 60°. This arrangement may further ensure the presence of the ambient air introduction path.

Thus, by undergoing the initial peeling process, the peelable laminated container 1 according to the present embodiment ensures that the ambient air introduction path extending from the air inlet holes 4 to the trunk portion 2*b* may be maintained. As a result, the introduction of ambient air to the trunk portion 2*b* in use is facilitated in a reliable manner, and the peeling of the inner layer body 3 from the outer layer body 2 is also facilitated, and moreover, the peelable laminated container 1 according to the present embodiment provides a wide range of selection of the shape of the container.

Figure 18:
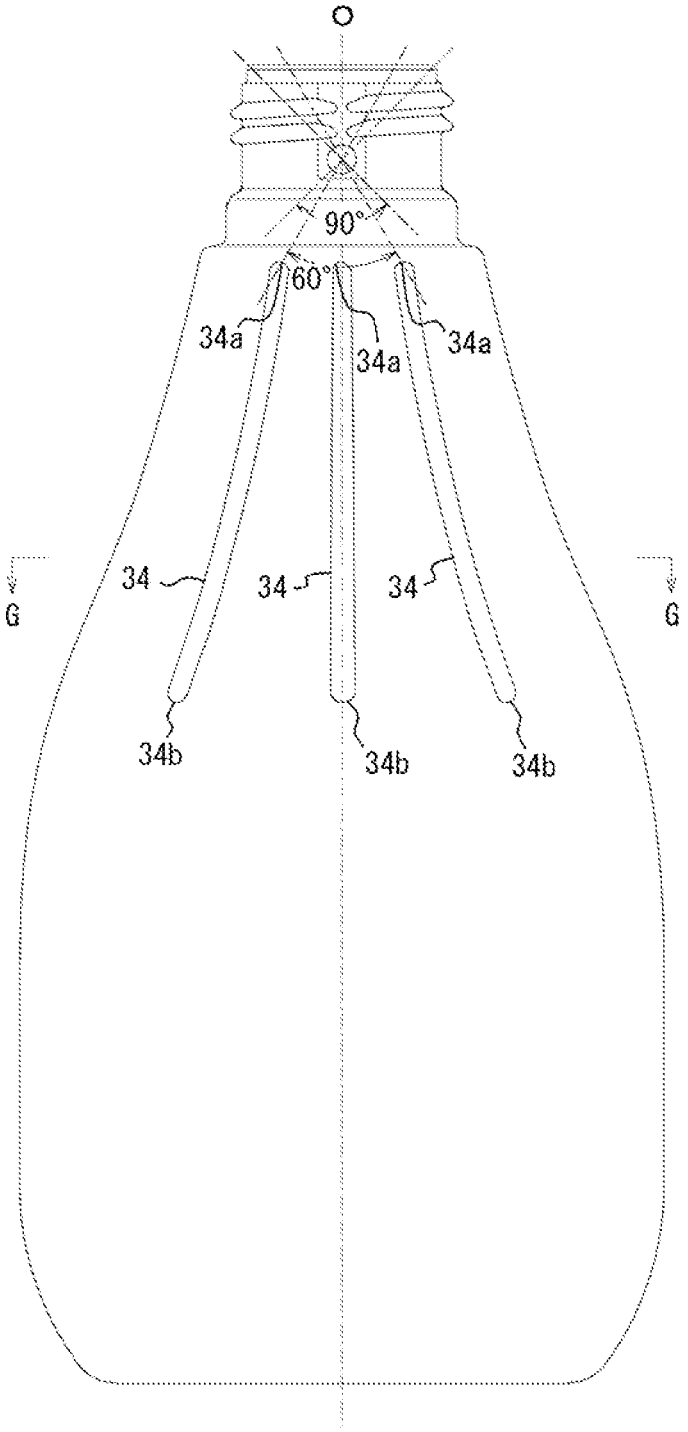
FIG. 18 is a side view of a peelable laminated container according to yet another embodiment of the present invention.
Figure 19:
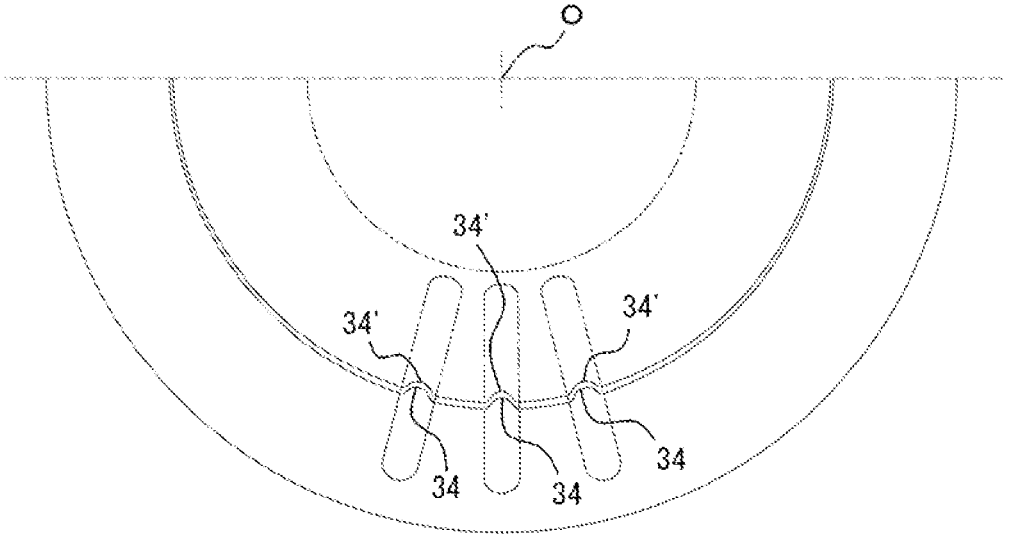
FIG. 19 is a sectional view taken along a line G-G in FIG. 18 before the initial peeling process.
Figure 20:
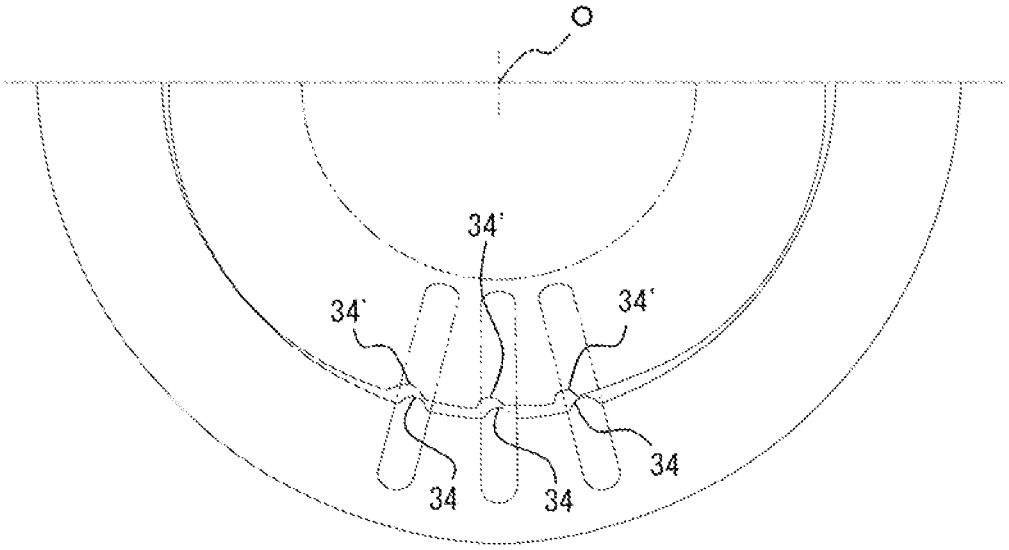
FIG. 20 is a sectional view taken along a line G-G in FIG. 18 after the initial peeling process.

With reference to FIGS. 18 to 20, a peelable laminated container according to yet another embodiment of the present invention will be described in detail below. FIG. 18 is a side view of the peelable laminated container according to the present embodiment. FIG. 19 is a sectional view taken along a line G-G in FIG. 18 before the initial peeling process. FIG. 20 is a sectional view taken along a line G-G in FIG. 18 after the initial peeling process.

The peelable laminated container in the present example has the same configuration as that in the above embodiment except for the number of outer-layer-side longitudinal ribs 34 as the outer-layer-side projecting portions and the number of inner-layer-side longitudinal ribs 34' as the inner-layer-side projecting portions. In the present example, the number of the outer-layer-side longitudinal ribs 34 is six in total, with three outer-layer-side longitudinal ribs 34 being provided in each of the opposing sides of the trunk portion. As for each of the outermost two outer-layer-side longitudinal ribs 34, as illustrated in FIG. 18, a line segment connecting an upper end 34*a* of the outer-layer-side longitudinal rib 34 and the center of the air inlet hole forms an angle of 30° with the axis line O.

Thus, in the area extending in the range of a central angle of 90° downward from the air inlet hole, at least one outer-layer-side longitudinal rib 34 is arranged. Furthermore, in each of two areas, one each on left and right sides, determined by excluding the area extending in the range of a central angle of less than 60° from the area extending in the range of a central angle of 90° downward from the air inlet hole 4, at least a portion of the outer-layer-side longitudinal rib 34 is arranged.

In the present example, similarly to the above embodiment, the arrangement of the outer-layer-side longitudinal ribs 34 ensures that space as illustrated in FIG. 20 may be maintained in peripheral areas of the outer-layer-side longitudinal ribs 34 when the initial peeling process is applied.

Thus, as in the above embodiment, by undergoing the initial peeling process, the peelable laminated container according to the present embodiment ensures that the ambient air introduction path extending from the air inlet holes to the trunk portion may be maintained. As a result, the introduction of ambient air to the trunk portion in use is facilitated, and the peeling of the inner layer body from the outer layer body is also facilitated, and moreover, the peelable laminated container according to the present embodiment provides a wide range of selection of the shape of the container.

Embodiments of the present invention have been described by way of example, and various changes may be made within the scope of the claims. For example, although the outer-layer-side longitudinal rib and the inner-layer-side longitudinal rib preferably have concave sectional shapes, the outer-layer-side longitudinal rib and the inner-layer-side longitudinal rib may also have convex sectional shapes. Furthermore, although the outer-layer-side longitudinal rib and the inner-layer-side longitudinal rib preferably extend vertically, the outer-layer-side longitudinal rib and the inner-layer-side longitudinal rib may also extend obliquely or in a zigzag manner. The lengths of the outer-layer-side longitudinal rib and the inner-layer-side longitudinal rib may also be adjusted as appropriate. Additionally, the content of the container is preferably but not limited to liquid such as face lotion, medicine, shampoo, or food. Moreover, although in the above example the cap including the check valve is attached to the dispensing spout provided in the container, the present invention is not limited to this example. For example, a pump or the like may be attached in use. Moreover, although in the above examples the inner layer body and the outer layer body are made of flexible materials, and the trunk portion may be squeezed in use, the present invention is not limited to these examples. For example, the outer layer body may also be made of a rigid material, and the inner layer body may shrink when the content is dispensed in use. Moreover, although the container is preferably configured by blow molding an integral molding prepared by co-extruding the outer layer body and the inner layer body as in the above examples, the present invention is not limited to these examples. For example, the container may be configured by blow molding the inner layer body and the outer layer body separately and by combining the molded bodies. In this case also, the ambient air introduction path extending from the dispensing spout to the peripheral areas of the outer-layer-side longitudinal ribs in the container is maintained.

REFERENCE SIGNS LIST

1 peelable laminated container (double container)
2 outer layer body
2*a* dispensing spout
2*b* trunk portion
2*c* bottom portion
3 inner layer body
3*a* opening
3*b* container portion
4 air inlet hole
5 outer-layer-side projecting portion
5*a* upper wall
5*b* lower wall
5*c* connecting wall
5*d* side wall
5*e* flat surface
5*f* inclined surface
5*g* cut-out surface
6 inner-layer-side projecting portion
7 metal mold
7*a* convex portion
7*b* bottom surface
11 outer-layer-side projecting portion
11*a* lower wall
11*b* upper wall
11*c* flat surface
11*d* curved surface
12 inner-layer-side projecting portion
15 rib set
16*a*-16*d* concave groove
17 outer layer rib (outer-layer-side projecting portion)
17*a*, 17*b* side wall portion
17*c* ceiling wall portion
17*d*, 17*e* linear portion
17*f* connecting side portion
18 sub-outer layer rib
18*a* inclined side
18*b* arc side
19 inner layer rib (inner-layer-side projecting portion)
26 annular stepped portion
27 cylindrical portion
28 mouth portion
30 screw thread
33, 34 outer-layer-side longitudinal rib (outer-layer-side projecting portion)
33*a*, 34*a* upper end (outer layer rib)
33*b*, 34*b* lower end (outer layer rib)
33', 34' inner-layer-side longitudinal rib (inner-layer-side projecting portion)
L line
O axis line

The invention claimed is:

1. A double container, comprising:

an outer layer body including a tubular dispensing spout and a trunk portion that is contiguous with the dispensing spout, the dispensing spout being provided in a side portion thereof with an air inlet hole extending through the dispensing spout from an inside to an outside thereof; and an inner layer body including an opening, which is contiguous with an opening edge of the dispensing spout, and a content container portion, which is contiguous with the opening, the inner layer body being accommodated in the outer layer body, wherein the trunk portion included in the outer layer body is provided with an outer-layer-side projecting portion, the inner layer body is provided with an inner-layer-side projecting portion having a shape that corresponds to an inner surface of the outer-layer-side projecting portion, space is provided between the outer-layer-side projecting portion and the inner-layer-side projecting portion, the inner surface of the outer-layer-side projecting portion that faces to a side of the inner layer body has an undercut shape in a longitudinal section thereof in a direction along an axis of the dispensing spout, and the inner-layer-side projecting portion, in a longitudinal section thereof, has a shape that corresponds to the inner surface of the outer-layer-side projecting portion.

2. The double container of claim 1, wherein the outer-layer-side projecting portion projects toward the inner layer body.

3. The double container of claim 2, wherein the trunk portion includes a bottom portion opposing to the dispensing spout, the bottom portion having a concave shape in which a center side thereof is depressed toward the dispensing spout relative to an outer circumferential edge of the bottom portion, and an outer surface of the outer-layer-side projecting portion that faces to an opposite side to the inner layer body has a concave shape including an inclined surface, which is inclined closer to the dispensing spout as the inclined surface extends further inward of the trunk portion, a flat surface, which is located closer to the dispensing spout relative to the inclined surface and which is perpendicular to the axis of the dispensing spout, and a cut-out surface, which connects the inclined surface and the flat surface and which is depressed toward the dispensing spout relative to the flat surface.

4. The double container of claim 2, wherein an outer surface of the outer-layer-side projecting portion that faces to an opposite side to the inner layer body has a concave shape including a flat surface, which is perpendicular to the axis of the dispensing spout, and a curved surface, which is located closer to the dispensing spout relative to the flat surface and which connects to the flat surface.

5. The double container of claim 1, wherein at least a portion of the outer-layer-side projecting portion is arranged in a range from 60 degrees to 90 degrees from an axis of the air inlet hole in a direction toward a bottom portion included in the trunk portion, in a plan view seen from an axis direction of the air inlet hole.

6. A double container comprising:

an outer layer body including a tubular dispensing spout and a trunk portion that is contiguous with the dispensing spout, the dispensing spout being provided in a side portion thereof with an air inlet hole extending through the dispensing spout from an inside to an outside thereof; and an inner layer body including an opening, which is contiguous with an opening edge of the dispensing spout, and a content container portion, which is contiguous with the opening, the inner layer body being accommodated in the outer layer body, wherein the trunk portion included in the outer layer body is provided with an outer-layer-side projecting portion, the inner layer body is provided with an inner-layer-side projecting portion having a shape that corresponds to an inner surface of the outer-layer-side projecting portion, space is provided between the outer-layer-side projecting portion and the inner-layer-side projecting portion, the outer-layer-side projecting portion comprises an outer layer rib extending in a direction from the dispensing spout to a bottom portion, an inner surface of the outer layer rib that faces to the side of the inner layer body has an undercut shape in a transverse section thereof, and the inner-layer-side projecting portion comprises an inner layer rib that, in a transverse section thereof, has a shape corresponding to the inner surface of the outer layer rib.

7. The double container of claim 6, wherein the outer layer rib, in a transverse section thereof, has a U-shape including a pair of side wall portions and a ceiling wall portion that connects the pair of side wall portions, and an outer surface of the outer layer rib that faces to an opposite side to the inner layer body, in a transverse section thereof, has a shape including a pair of outer surfaces of the side wall portions having linear portions which is in parallel with each other, and an outer surface of the ceiling wall portion having a connecting side portion which connects the pair of linear portions.

8. The double container of claim 7, wherein the trunk portion of the outer layer body is further provided with a sub-outer layer rib that is adjacent to the outer layer rib, and an outer surface of the sub-outer layer rib that faces to the opposite side to the inner layer body, in a transverse section thereof, has a shape including an inclined side, which connects to the linear portion of the outer layer rib and which is inclined relative to the linear portion.

9. The double container of claim 8, wherein in the transverse section, the linear portion of the outer layer rib extends substantially in parallel with a line that passes a widthwise middle point of the sub-outer layer rib and that also passes an axis of the dispensing spout.

10. The double container of claim 6, wherein at least a portion of the outer layer rib is arranged in a range from 60 degrees to 90 degrees from an axis of the air inlet hole in a direction toward the bottom portion, in a plan view seen from an axis direction of the air inlet hole.

11. The double container of claim 6, wherein the outer layer rib and the inner layer rib are arranged in an area extending in the range of a central angle of 90° downward from the air inlet hole.

12. The double container of claim 11, wherein the outer layer rib is provided in plurality, and the plurality of outer layer ribs comprise at least four outer layer ribs, and two areas, one each on left and right sides, determined by excluding an area extending in the range of a central angle of less than 60° downward from the air inlet hole, from the area extending in the range of a central angle of 90° downward from the air inlet hole, communicate to areas defined between two outer layer ribs in pair.

* * * * *